US012044237B2

(12) United States Patent
Wang et al.

(10) Patent No.: US 12,044,237 B2
(45) Date of Patent: Jul. 23, 2024

(54) SCROLL COMPRESSOR WITH IMPROVED SEALING PERFORMANCE OF BACK PRESSURE CHAMBER

(71) Applicant: Hangzhou Lvneng New Energy Vehicle Parts Co., LTD., Hangzhou (CN)

(72) Inventors: Taojie Wang, Hangzhou (CN); Yubao Si, Hangzhou (CN); Bin Yin, Hangzhou (CN)

(73) Assignee: HANGZHOU LVNENG NEW ENERGY VEHICLE PARTS CO., LTD., Hangzhou (CN)

( * ) Notice: Subject to any disclaimer, the term of this patent is extended or adjusted under 35 U.S.C. 154(b) by 0 days.

(21) Appl. No.: 18/204,914

(22) Filed: Jun. 1, 2023

(65) Prior Publication Data

US 2023/0392596 A1 Dec. 7, 2023

(30) Foreign Application Priority Data

Jun. 1, 2022 (CN) ..... 202210617492.3

(51) Int. Cl.
*F16J 15/32* (2016.01)
*F01C 17/06* (2006.01)
(Continued)

(52) U.S. Cl.
CPC ..... *F04C 18/0215* (2013.01); *F04C 18/0246* (2013.01); *F04C 18/0253* (2013.01);
(Continued)

(58) Field of Classification Search
CPC ..... F04C 18/0215; F04C 18/0246; F04C 18/0253; F04C 27/00; F04C 27/005;
(Continued)

(56) References Cited

U.S. PATENT DOCUMENTS

| | | | | |
|---|---|---|---|---|
| 9,945,380 | B2 | 4/2018 | Schneider et al. | |
| 2007/0071626 | A1* | 3/2007 | Tsuchiya ..... | F04C 27/005 418/55.4 |

(Continued)

FOREIGN PATENT DOCUMENTS

| | | | |
|---|---|---|---|
| CN | 201461409 | U | 5/2010 |
| CN | 202417864 | U | 9/2012 |
| CN | 203453065 | U | 2/2014 |

*Primary Examiner* — Deming Wan
(74) *Attorney, Agent, or Firm* — Cheng-Ju Chiang

(57) ABSTRACT

A scroll compressor includes a movable scroll and a fixed portion. The fixed portion has a first bearing surface. The movable scroll has a second bearing surface. The scroll compressor includes a back pressure chamber located between the movable scroll and the fixed portion. At least one of the movable scroll and the fixed portion is provided with a groove disposed on a periphery of the back pressure chamber. The scroll compressor further includes a sealing assembly at least partially installed in the groove. One end of the sealing assembly is in contact with a groove bottom surface in the groove, and another end of the sealing assembly is in contact with the first bearing surface or the second bearing surface. The sealing assembly includes a wear-resistant ring and an elastic ring. The elastic ring has at least one recess on a surface thereof.

20 Claims, 19 Drawing Sheets

(51) Int. Cl.
*F04C 18/02* (2006.01)
*F04C 23/00* (2006.01)
*F04C 27/00* (2006.01)

(52) U.S. Cl.
CPC ..... *F04C 27/003* (2013.01); *F04C 27/005* (2013.01); *F04C 27/007* (2013.01); *F04C 27/008* (2013.01); *F04C 2240/50* (2013.01); *F04C 2240/60* (2013.01)

(58) Field of Classification Search
CPC .... F04C 27/003; F04C 27/008; F04C 27/007; F04C 23/008; F16J 15/3208; F01C 17/066
See application file for complete search history.

(56) References Cited

U.S. PATENT DOCUMENTS

2014/0248172 A1* 9/2014 Nagano ..... F04C 18/0215 418/55.4
2018/0023570 A1* 1/2018 Huang ..... F04C 27/003 418/55.4
2020/0232462 A1* 7/2020 Park ..... F04C 27/001

* cited by examiner

SCROLL COMPRESSOR WITH IMPROVED SEALING PERFORMANCE OF BACK PRESSURE CHAMBER

CROSS-REFERENCE TO RELATED APPLICATION

This patent application claims priority of a Chinese Patent Application No. 202210617492.3, filed on Jun. 1, 2022 and titled "SCROLL COMPRESSOR", the entire content of which is incorporated herein by reference.

TECHNICAL FIELD

The present disclosure belongs to a field of compressors, and in particular, relates to a scroll compressor.

BACKGROUND

A movable scroll and a fixed scroll jointly form a plurality of compression chambers of a scroll compressor. When the movable scroll moves relative to the fixed scroll, sucked oil-gas mixture medium reaches a radially outer compression chamber through an inlet, and gradually reaches a radially central compression chamber from the outer compression chamber. The volume of the compression chamber decreases radially from outside to inside, which causes the pressure to increase as more and more media is compressed. Due to the pressure generated in the compression chamber, an axial force will be generated to separate the movable scroll and the fixed scroll, and a gap will be generated to cause leakage of the compressed medium.

In order to avoid this situation as much as possible, a back pressure chamber is set on a back side of the movable scroll, in which a specific pressure is generated to generate an axial reaction force. If necessary, the movable scroll can be pressed against the fixed scroll in addition to the oil film between friction surfaces of the movable scroll and the fixed scroll.

In order to improve the sealing performance of the back pressure chamber, it is necessary to propose an improved scroll compressor.

SUMMARY

An object of the present disclosure is to provide a scroll compressor which improves the sealing performance of a back pressure chamber thereof.

In order to achieve the above object, the present disclosure adopts the following technical solution: a scroll compressor, including a movable scroll and a fixed portion, the movable scroll cooperating with the fixed portion, the fixed portion having a first bearing surface, the movable scroll having a second bearing surface; wherein the scroll compressor includes a back pressure chamber located between the movable scroll and the fixed portion; at least one of the movable scroll and the fixed portion is provided with a groove disposed on a periphery of the back pressure chamber; the scroll compressor further includes a sealing assembly at least partially installed in the groove; one end of the sealing assembly is in contact with a groove bottom surface in the groove; another end of the sealing assembly at least partially located in the groove of the movable scroll is in contact with the first bearing surface of the fixed portion and/or another end of the sealing assembly at least partially located in the groove of the fixed portion is in contact with the second bearing surface of the movable scroll; the sealing assembly includes a wear-resistant ring and an elastic ring; the wear-resistant ring and the elastic ring are at least partially stacked along a depth direction of the groove; and the elastic ring is provided with at least one recess on a surface thereof.

In order to achieve the above object, the present disclosure adopts the following technical solution: a scroll compressor, including: a fixed portion having a first bearing surface; a movable scroll having a second bearing surface facing the first bearing surface; the movable scroll being rotatable with respect to the fixed portion; a back pressure chamber formed by the movable scroll and the fixed portion; and a sealing assembly including a wear-resistant ring and an elastic ring; wherein at least one of the movable scroll and the fixed portion is provided with a groove disposed on a periphery of the back pressure chamber; the sealing assembly is at least partially installed in the groove; one end of the sealing assembly is in contact with an abutting surface in the groove along a depth direction of the groove; another end of the sealing assembly at least partially located in the groove of the movable scroll is in contact with the first bearing surface and/or another end of the sealing assembly at least partially located in the groove of the fixed portion is in contact with the second bearing surface along the depth direction of the groove; the wear-resistant ring and the elastic ring are at least partially stacked along the depth direction of the groove; and the elastic ring is provided with at least one recess on a surface thereof so as to enhance an elastic performance thereof.

In the scroll compressor provided by the present disclosure, the sealing assembly is used to seal between the fixed portion and the movable scroll, the sealing assembly includes the wear-resistant ring and the elastic ring, and the elastic force provided by the elastic ring pushes the wear-resistant ring, so that the sealing assembly is always abutted and sealed between the movable scroll and the fixed portion. Besides, the recess is provided on the surface of the elastic ring, so that the elastic performance of the elastic ring is enhanced, thereby improving the sealing performance of the back pressure chamber.

BRIEF DESCRIPTION OF DRAWINGS

In order to more clearly illustrate the technical solutions in the embodiments of the present disclosure, the following will briefly introduce the drawings that need to be used in the description of the embodiments. Apparently, the drawings in the following description are only some embodiments of the present disclosure. For those skilled in the art, other drawings can also be obtained based on these drawings without any creative effort.

DETAILED DESCRIPTION

Figure 1:
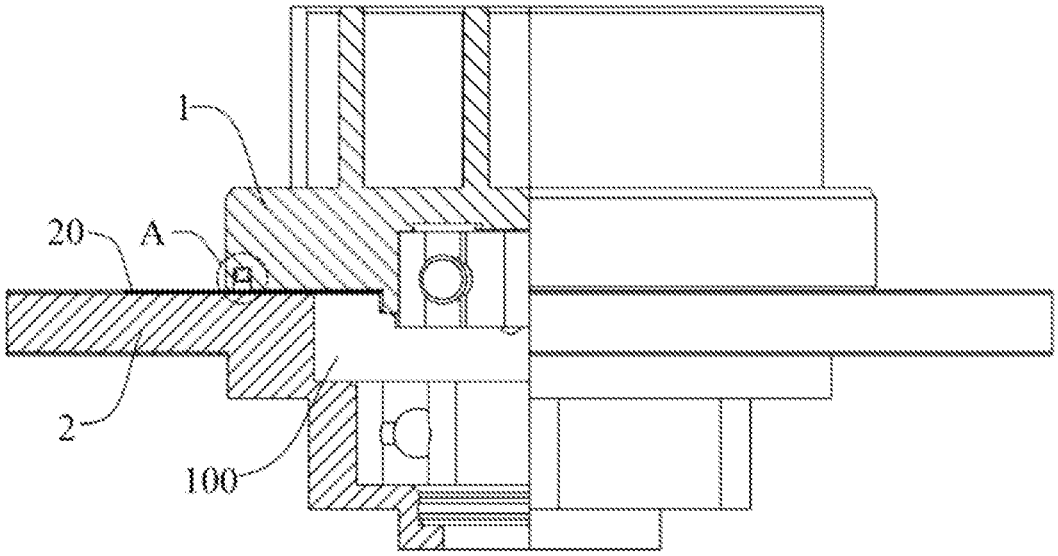
FIG. 1 is a half-sectional view of a groove formed on a movable scroll in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 5:
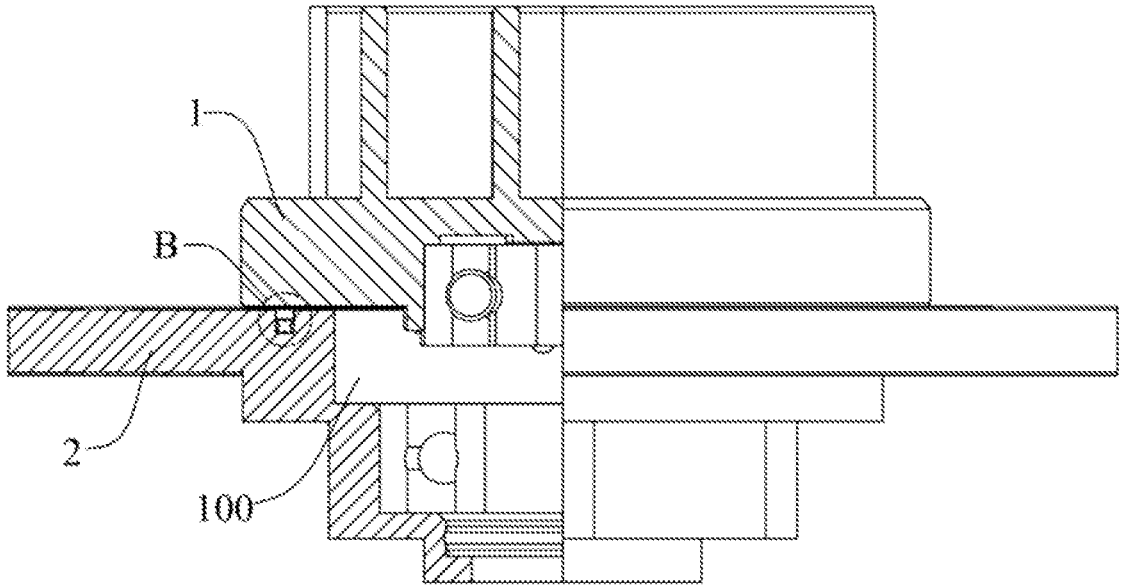
FIG. 5 is a half-sectional view of a groove formed on a fixed portion in accordance with an embodiment of the present disclosure.
Figure 6:
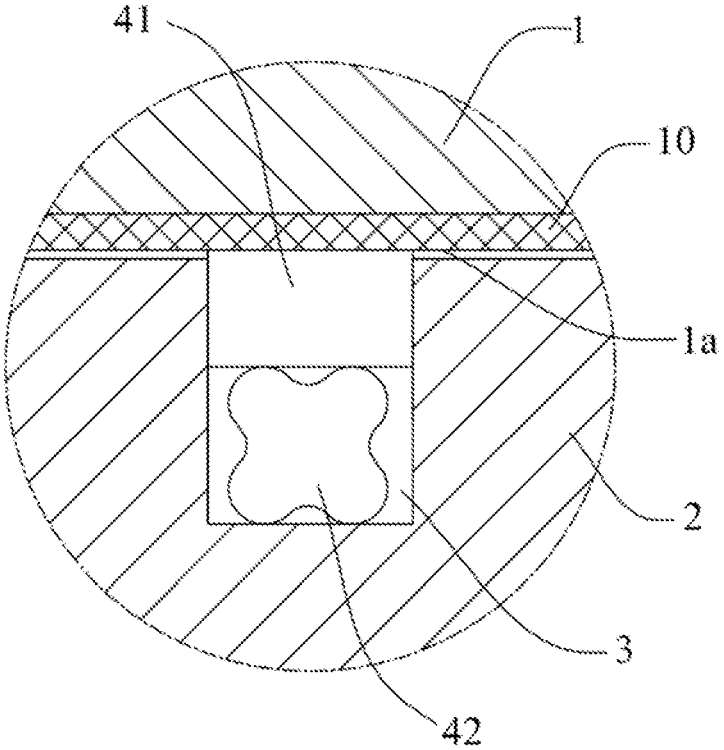
FIG. 6 is a partially enlarged view of circle B in FIG. 5.
Figure 7:
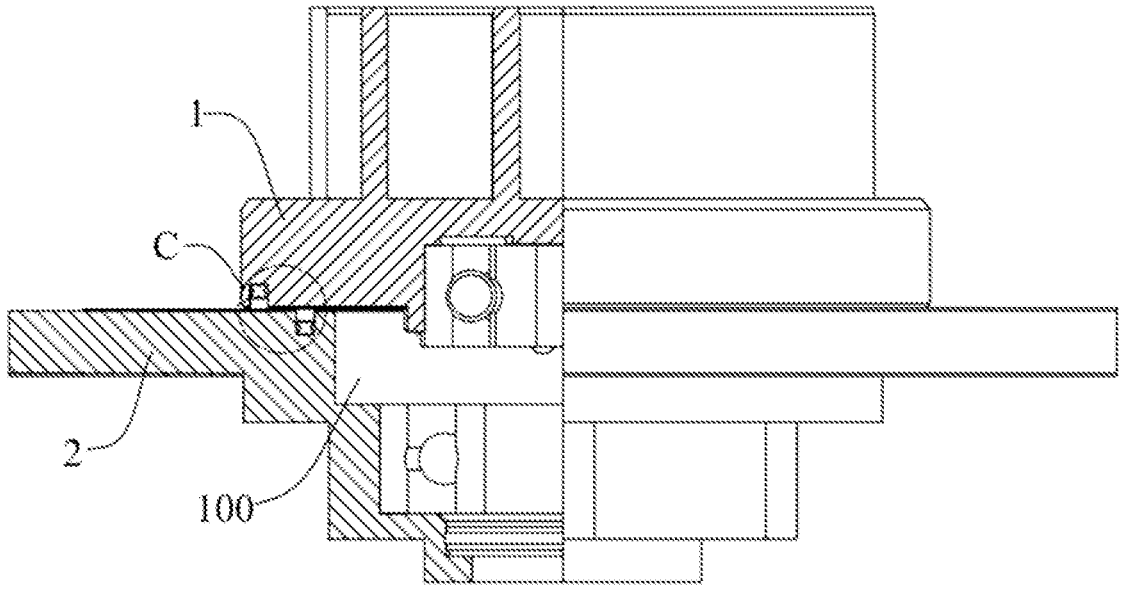
FIG. 7 is a half-sectional view of grooves formed on both the movable scroll and the fixed portion in accordance with an embodiment of the present disclosure.
Figure 8:
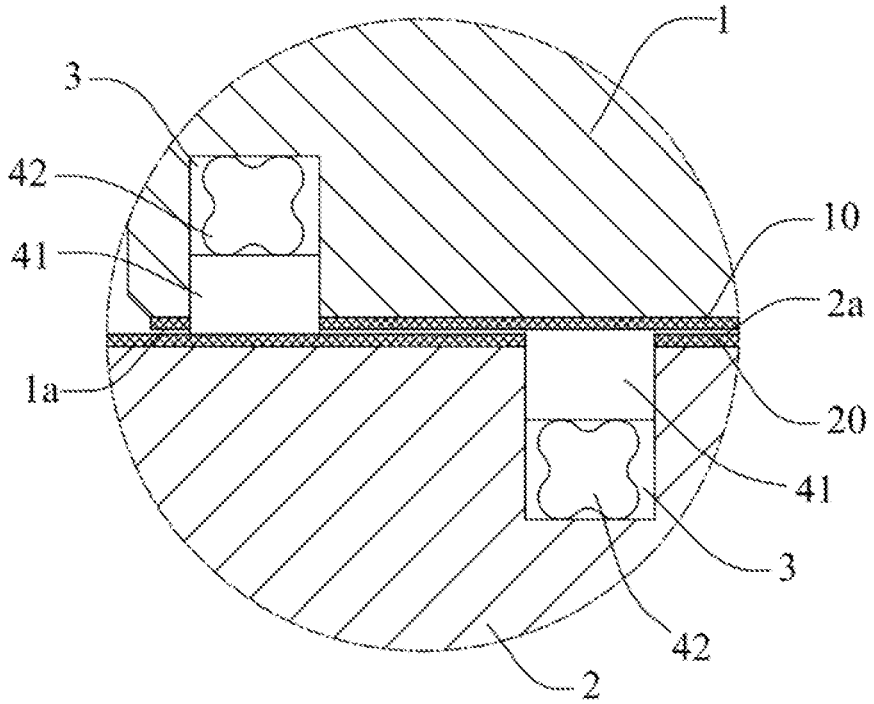
FIG. 8 is a partially enlarged view of circle C in FIG. 7.

As shown in FIGS. 1 to 8, a scroll compressor provided in this embodiment specifically includes a movable scroll 1 and a fixed portion 2. The movable scroll 1 and the fixed portion 2 are disposed adjacently. One end of the fixed portion 2 adjacent to the movable scroll 1 has a first bearing surface 2*a*. One end of the movable scroll 1 adjacent to the fixed portion 2 has a second bearing surface 1*a*. Aback pressure chamber 100 is formed between the movable scroll 1 and the fixed portion 2. At least one of the movable scroll 1 and the fixed portion 2 is provided with a groove 3. The groove 3 is disposed on a periphery of the back pressure chamber 100. The scroll compressor further includes a sealing assembly 4 installed at least partially in the groove 3. One end of the sealing assembly 4 is in contact with a groove bottom surface 3*a* in the groove 3, and another end of the sealing assembly 4 is in contact with the first bearing surface 2*a* of the fixed portion 2 or the second bearing surface 1*a* of the movable scroll 1. In this embodiment, the location of the groove 3 is not specifically limited. The groove 3 may be disposed at an end of the movable scroll 1 adjacent to the fixed portion 2; that is, the groove 3 is provided on the movable scroll 1 (as shown in FIGS. 1 to 4). The groove 3 may also be provided on an end of the fixed portion 2 adjacent to the movable scroll 1; that is, the groove 3 is provided on the fixed portion 2 (as shown in FIG. 5 and FIG. 6). It is also possible that the movable scroll 1 and the fixed portion 2 are provided with the groove 3 at adjacent ends; that is, both the movable scroll 1 and the fixed portion 2 are provided with the groove 3 (as shown in FIG. 7 and FIG. 8).

In the following, the groove 3 provided on the fixed portion 2 will be taken as an example for description.

Figure 2:
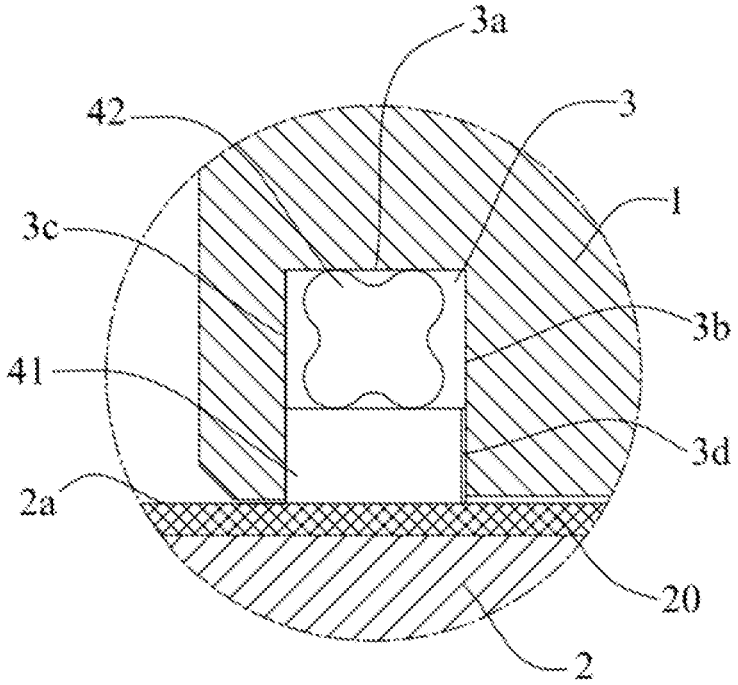
FIG. 2 is a partially enlarged view of circle Ain FIG. 1.
Figure 9A:
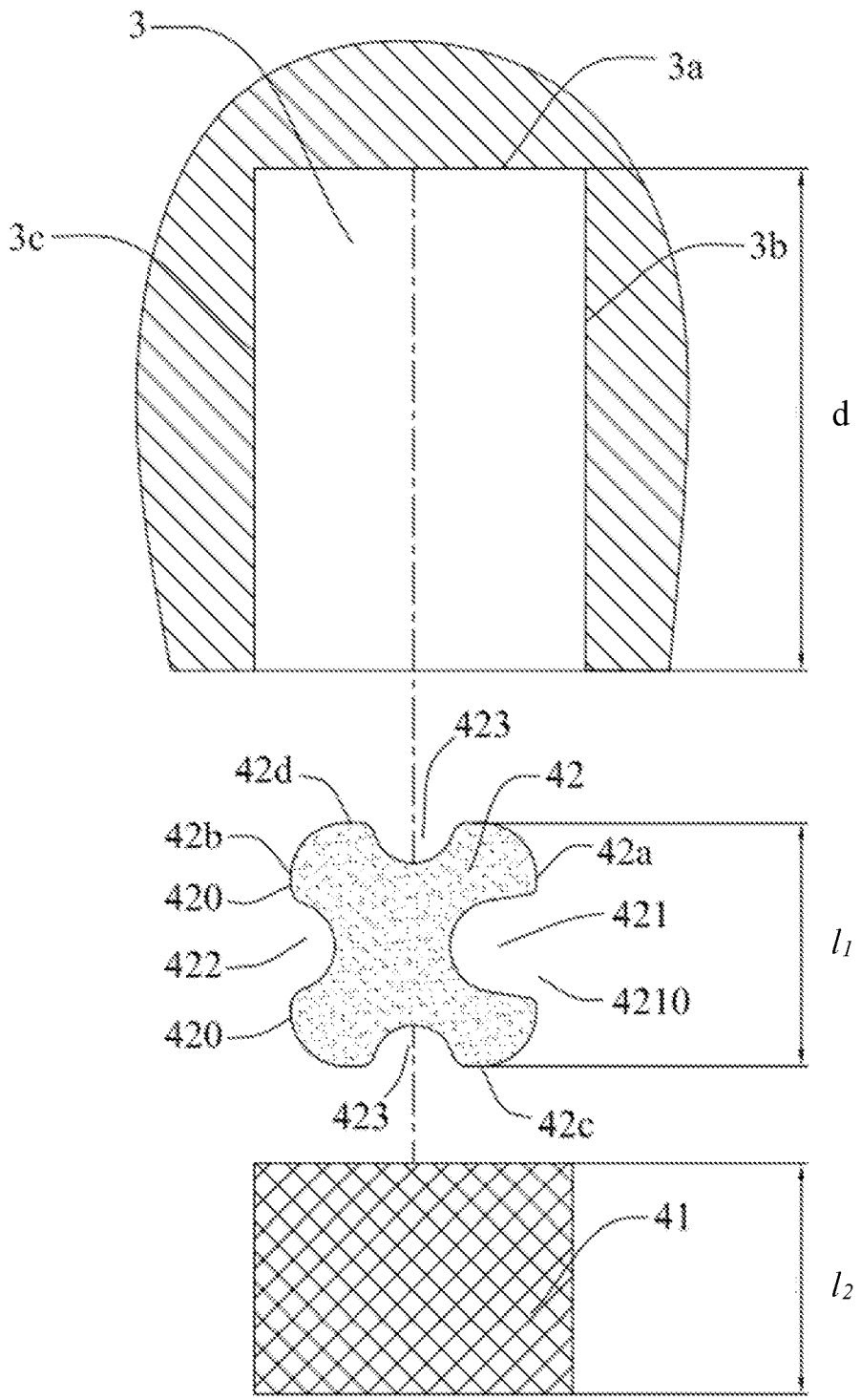
FIG. 9*a* is a cross-sectional view of a sealing assembly and the groove in accordance with an embodiment of the present disclosure after disassembly.
Figure 9B:
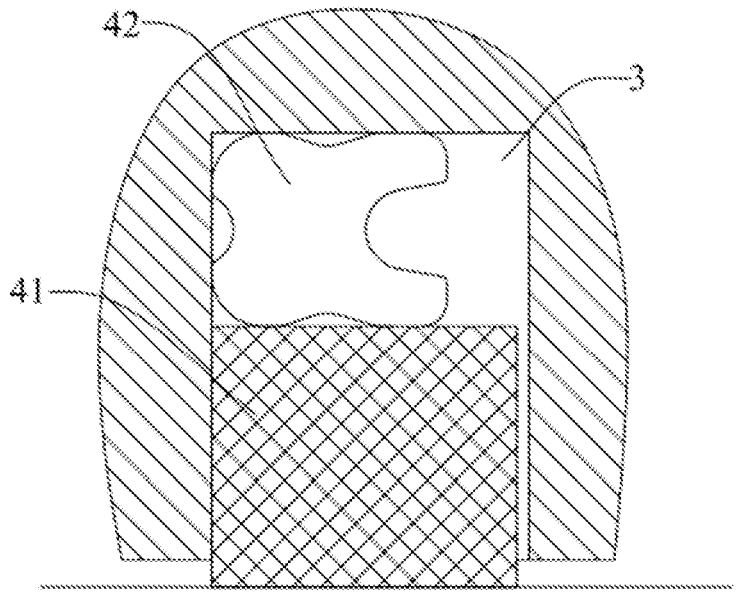
FIG. 9*b* is a cross-sectional view of the sealing assembly and the groove mated with each other in accordance with an embodiment of the present disclosure.

Referring to FIG. 2 and FIG. 4 again, the sealing assembly 4 includes a wear-resistant ring 41 and an elastic ring 42. The wear-resistant ring 41 and the elastic ring 42 are stacked along a depth direction of the groove 3. In this embodiment, the depth direction of the groove 3 is not limited whether it is from an opening of the groove 3 toward the groove bottom surface 3*a*, or from the groove bottom surface 3*a* toward the opening. In particular, the elastic ring 42 is installed in the groove 3, and the wear-resistant ring 41 is at least partially installed in the groove 3. The elastic ring 42 is located between the wear-resistant ring 41 and the groove bottom surface 3*a* of the groove 3. Referring to FIGS. 9*a* and 9*b*, along the depth direction of the groove 3, the elastic ring 42 includes a first end surface 42*c* and a second end surface 42*d*. One end of the wear-resistant ring 41 is in contact with the first end surface 42*c* of the elastic ring 42, and another end of the wear-resistant ring 41 is in contact with the first bearing surface 2*a* of the fixed portion 2. The second end surface 42*d* of the elastic ring 42 is in contact with the groove bottom surface 3*a*. In the scroll compressor, the movable scroll 1 needs to rotate to realize the function of compressing the medium. Therefore, in this embodiment, the wear resistance of the sealing assembly 4 is enhanced by providing the wear-resistant ring 41. During the rotation of the movable scroll 1 relative to the fixed portion 2, the sealing assembly 4 performs sliding friction with the first bearing surface 2*a* through the wear-resistant ring 41. It solves the problem that the use of a single sealing ring for sealing will cause the sealing ring to be easily worn due to sliding friction, resulting in a decrease in the sealing performance of the back pressure chamber, which in turn leads to the problem of compressed medium leakage due to the separation of the movable scroll and the fixed scroll. In this embodiment, the wear-resistant ring 41 and the elastic ring 42 are provided, and the elasticity provided by the elastic ring 42 realizes the dynamic sealing of the back pressure chamber 100 between the movable scroll 1 and the fixed portion 2. At the same time, the wear-resistant ring 41 makes sliding contact, which has strong wear resistance and prolongs the overall service life of the sealing assembly 4.

Further, in order to reduce the sliding friction between the elastic ring 42 and the wear-resistant ring 41 and the groove bottom surface 3*a*, in this embodiment, a friction coefficient between the wear-resistant ring 41 and the elastic ring 42 is greater than a friction coefficient between the wear-resistant ring 41 and the first bearing surface 2*a* or the second bearing surface 1*a*. A friction coefficient between the elastic ring 42 and the groove bottom surface 3*a* is greater than the friction coefficient between the wear-resistant ring 41 and the first bearing surface 2*a* or the second bearing surface 1*a*. Through such a design, the friction between the elastic ring 42 and the wear-resistant ring 41 and the groove bottom surface 3*a* of the groove 3 is reduced or avoided, the wear of the elastic ring 42 is reduced, and the sealing performance of the back pressure chamber 100 is maintained for a long time.

In this embodiment, along a width direction of the groove 3 (the width direction of the groove 3 is perpendicular to the depth direction of the groove 3), the groove 3 includes an inner annular surface 3*b* and an outer annular surface 3*c*. A diameter of the outer annular surface 3*c* is larger than a diameter of the inner annular surface 3*b*. Both the inner annular surface 3*b* and the outer annular surface 3*c* are in contact with the groove bottom surface 3*a*. The inner annular surface 3*b*, the outer annular surface 3*c* and the groove bottom surface 3*a* form the groove 3 with the opening. The elastic ring 42 is installed in the groove 3. Along the width direction of the groove 3, the elastic ring 42 has an inner peripheral side 42*a* and an outer peripheral side 42*b*. A diameter of the inner peripheral side 42*a* is smaller than a diameter of the outer peripheral side 42*b*. During the process of compressing the medium in the scroll compressor, the movable scroll 1 is able to float relative to the fixed portion 2. When the movable scroll 1 is close to the fixed portion 2, the elastic ring 42 is deformed subjected to pressure, and a certain space needs to be ensured to meet the elastic deformation requirement of the elastic ring 42. Therefore, when the elastic ring 42 is not subjected to pressure along the depth direction of the groove 3, a gap is formed between the inner peripheral side 42*a* of the elastic ring 42 and the inner annular surface 3*b*, and/or is formed between the outer peripheral side 42*b* of the elastic ring 42 and the outer annular surface 3*c*. That is, when the elastic ring 42 is installed in the groove 3 and there is no axial pressure on the elastic ring 42, there is a gap between the elastic ring 42 and the inner annular surface 3*b* and/or the outer annular surface 3*c* of the groove 3. When the elastic ring 42 is pressed, the elastic ring 42 is able to expand to the gap between the elastic ring 42 and an annular surface of the groove 3, which prevents the elastic ring 42 from being ruptured subjected to pressure due to the lack of gap between the elastic ring 42 and the annular surface of the groove 3, or affecting the floating adjustment of the movable scroll 1.

In order to improve the sealing performance of the back pressure chamber 100, it is necessary to ensure that the elastic ring 42 has enough elasticity to adapt to the pressure in the back pressure chamber 100 to deform so as to keep against the groove bottom surface 3*a* and the wear-resistant ring 41. In this embodiment, the elastic ring 42 has at least one recess. By providing the recess on the elastic ring 42, the elastic performance of the elastic ring 42 is enhanced, and the sealing requirement between the movable scroll 1 and the fixed portion 2 can be better met. Besides, the sealing performance of the back pressure chamber 100 is enhanced, it is prevented that the pressure in the back pressure chamber 100 leaks and causes insufficient axial reaction force, which causes the compressed medium in the scroll compressor to leak.

Figure 3:
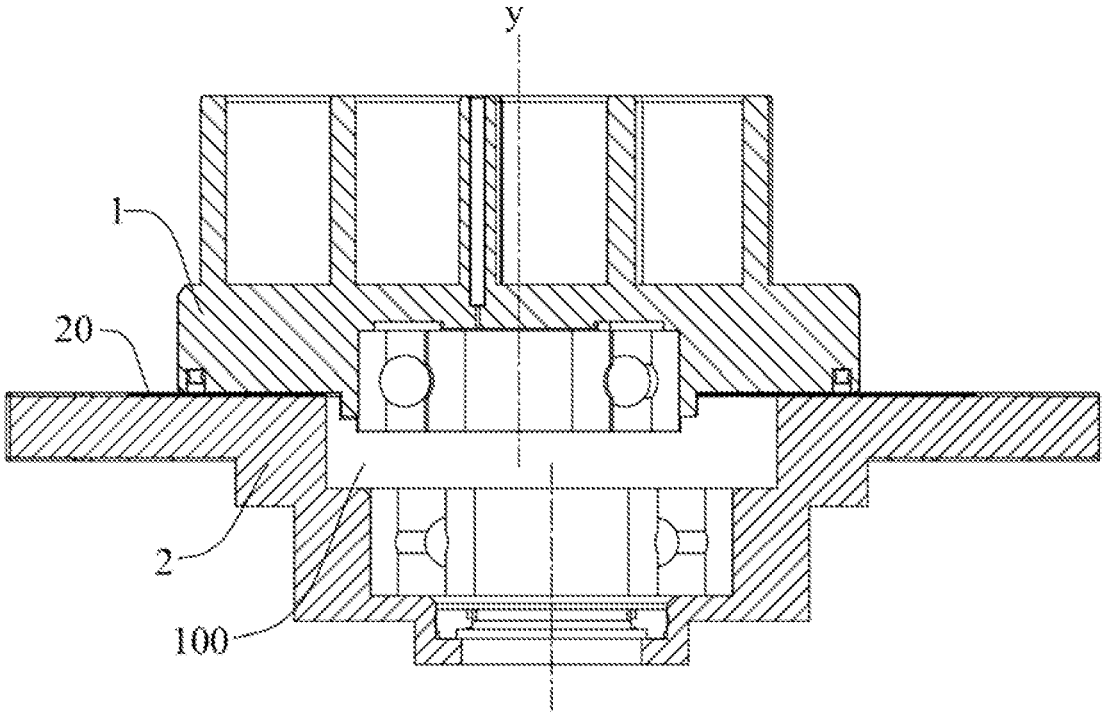
FIG. 3 is a full sectional view of the groove formed on the movable scroll in accordance with an embodiment of the present disclosure.
Figure 4:
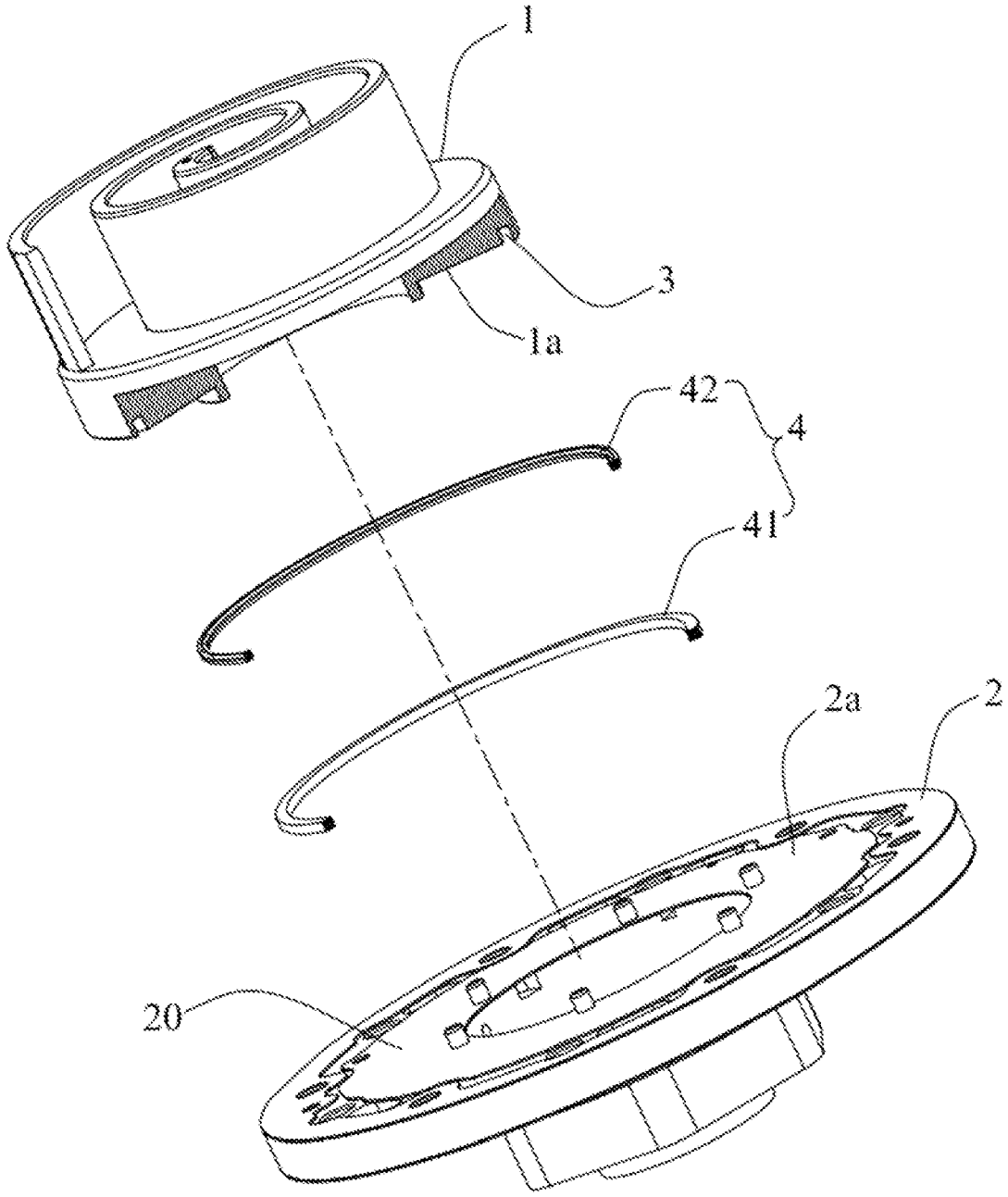
FIG. 4 is a partial structural view of a scroll compressor in accordance with an embodiment of the present disclosure.

Referring to FIG. 9*a* and FIG. 9*b* again, and in conjunction with FIG. 3, in the above embodiment, the recess includes a first recess 421. The first recess 421 is located on the inner peripheral side 42*a* of the elastic ring 42. By providing the first recess 421 on the inner peripheral side 42*a* of the elastic ring 42, the axial elasticity of the elastic ring 42 is enhanced. During the floating process of the movable scroll 1 relative to the fixed portion 2, the elastic ring 42 can better meet the floating requirement of the movable scroll 1 and better ensure the sealing performance of the back pressure chamber 100. Further, when the elastic ring 42 is not subjected to pressure along the depth direction of the groove 3, there is a gap between the inner peripheral side 42*a* of the elastic ring 42 and the inner annular surface 3*b*. Moreover, at least part of the opening 4210 of the first recess 421 faces the inner annular surface 3*b* of the groove 3, so that at least part of the opening 4210 of the first recess 421 communicates with the back pressure chamber 100. With such a design, the pressurized medium in the back pressure chamber 100 can enter the first recess 421 through the opening 4210, and expand the elastic ring 42. This makes the elastic ring 42 more tightly contact with the groove bottom surface 3*a* and the wear-resistant ring 41, and even pushes the outer peripheral side 42*b* of the elastic ring 42 to contact and seal with the outer annular surface 3*c* to form multiple seals. As a result, the sealing performance is greatly enhanced to achieve the effect of preventing pressure leakage from the back pressure chamber 100. In this embodiment, the first recess 421 is disposed at the axial center position of the inner peripheral side 42*a* of the elastic ring 42. In this embodiment, the first recess 421 may be distributed in a ring shape along a central axis y of the elastic ring 42, or the first recess 421 may be arc-shaped and distributed in a circular array along the central axis y of the elastic ring 42 (not shown in the drawings). A direction of the central axis y of the elastic ring 42 is parallel to the depth direction of the groove 3.

To further enhance the elastic performance of the elastic ring 42, the recess includes a second recess 422. The outer peripheral side 42*b* of the elastic ring 42 has at least one second recess 422. By disposing the second recess 422 on the outer peripheral side 42*b* of the elastic ring 42, the axial elastic expansion and contraction performance of the elastic ring 42 is further enhanced. In this embodiment, the second recess 422 is distributed in a ring shape along the central axis y of the elastic ring 42, or the second recess 422 is arc-shaped and distributed in a circular array along the central axis y of the elastic ring 42 (not shown in the drawings). Alternatively, the second recess 422 is distributed in a spiral shape along the central axis y of the elastic ring 42 (not shown in the drawings). In this embodiment, by disposing the second recess 422 on the outer peripheral side 42*b* of the elastic ring 42, in addition to enhancing the elasticity of the elastic ring 42, the elastic ring 42 can also form protrusions 420 on two sides of the second recess 422. The protrusions 420 can form multiple seals with the outer annular surface of the groove 3 to realize multiple seals, thereby enhancing the sealing performance of the back pressure chamber 100.

Furthermore, the recess further includes a third recess 423. The elastic ring 42 has at least one third recess 423 on at least one of the first end surface 42*c* and the second end surface 42*d*. The elasticity of the elastic ring 42 is further enhanced by providing the third recess 423 on the first end surface 42*c* and/or the second end surface 42*d* of the elastic ring 42. Meanwhile, the elastic ring 42 can also form a plurality of protrusions 420 on sides of the third recess 423. Each protrusion 420 can form a seal with a corresponding groove bottom surface 3*a* or with the wear-resistant ring 41. The tightness of the back pressure chamber 100 is further improved by multiple seals. In this embodiment, the third recess 423 is distributed in a ring shape along the central axis y of the elastic ring 42. Alternatively, the third recess 423 is arc-shaped and distributed in a circular array along the central axis y of the elastic ring 42 (not shown in the drawings).

In the above embodiment, when the elastic ring 42 is not subjected to pressure along the depth direction of the groove 3, a maximum dimension of the elastic ring 42 along the depth direction of the groove 3 is $l_1$; a dimension of the wear-resistant ring 41 along the depth direction of the groove 3 is $l_2$; a sum of $l_1$ and $l_2$ is $L_1$; a depth of the groove 3 is d, where $L_1$>d. This makes the elastic ring 42 in a compressed state, the elastic ring 42 presses and seals against the groove bottom surface 3*a* in the groove 3 and the wear-resistant ring 41, and pushes the wear-resistant ring 41 to keep resisting against the first bearing surface 2*a* of the fixed portion 2 during the relative sliding process, thereby ensuring the sealing performance of the back pressure chamber 100. In addition, in the above embodiment, a depth of the first recess 421 is greater than that of other recesses. Of course, cross-sectional shapes of the recesses provided on the elastic ring 42 may also be the same.

In the above embodiment, the elastic ring 42 is an elastomer, while the wear-resistant ring 41 is a non-elastomer. A material of the elastic ring 42 is rubber. A material of wear-resistant ring 41 includes any of the modified polytetrafluoroethylene (PTFE), polyphenylene sulfide (PPS), polyether ether ketone (PEEK), single polyoxymethylene resin (Delrin), and polyimide plastic (Pi).

Referring to FIG. 1 to FIG. 4 again, in the above embodiment, the fixed portion 2 includes a first wear-resistant plate 20. The first wear-resistant plate 20 is disposed at an end of the fixed portion 2 adjacent to the movable scroll 1. An end of the first wear-resistant plate 20 facing the movable scroll 1 has the first bearing surface 2*a*. The wear-resistant ring 41 is in contact with the first bearing surface 2*a* of the first wear-resistant plate 20. By providing the first wear-resistant plate 20, the wear-resistant ring 41 is in sliding contact with the first wear-resistant plate 20 instead of directly contacting the fixed portion 2 when the movable scroll 1 rotates relative to the fixed portion 2. When wear occurs, the first wear-resistant plate 20 and/or the wear-resistant ring 41 can be replaced instead of replacing the entire fixed portion 2, thereby reducing the maintenance cost of the scroll compressor. Wherein, a main body of the fixed portion 2 is a bearing seat. In this embodiment, the arrangement of the first wear-resistant plate 20 is not specifically limited, and it may be connected to the bearing seat through a fastener, a pin, etc., or may be connected through bonding, clamping or other methods.

The above embodiment is described by taking the groove 3 provided on the movable scroll 1 as an example.

As shown in FIG. 5 and FIG. 6, in another embodiment, the difference from the above embodiment is that the groove 3 is provided at an end of the fixed portion 2 adjacent to the movable scroll 1. That is, the groove 3 is disposed on the fixing portion 2. The wear-resistant ring 41 in the sealing assembly 4 is in contact with the second bearing surface 1*a* of the movable scroll 1. The movable scroll 1 includes a second wear-resistant plate 10. The second wear-resistant plate 10 is disposed at an end of the movable scroll 1 adjacent to the fixed portion 2. An end of the second wear-resistant plate 10 facing the fixed portion 2 has the second bearing surface 1*a*. The wear-resistant ring 41 is in contact with the second bearing surface 1*a* of the second wear-resistant plate 10. By providing the second wear-resistant plate 10, during the rotation of the movable scroll 1 relative to the fixed portion 2, the wear-resistant ring 41 is in sliding contact with the second wear-resistant plate 10 instead of directly contacting the fixed portion 2. When wear occurs, the second wear-resistant plate 10 and/or the wear-resistant ring 41 can be replaced instead of replacing the entire movable scroll 1, thereby reducing the maintenance cost of the scroll compressor. Wherein, a main body of the movable scroll 1 is a movable scroll plate. In this embodiment, the arrangement of the first wear-resistant plate 20 is not specifically limited, and it may be connected to the movable scroll plate through a fastener, a pin, etc., or may be connected through bonding, clamping or other methods. In this embodiment, the remaining parts are the same as the case where the groove 3 is provided on the movable scroll 1, and will not be described here again.

As shown in FIG. 7 and FIG. 8, in some other embodiments, the difference from the above-mentioned embodiments is that the movable scroll 1 and the fixed portion 2 are provided with the groove 3 at adjacent ends, that is, the movable scroll 1 and the fixed portion 2 are both provided with the groove 3. In addition, the scroll compressor further includes a first wear-resistant plate 20 and a second wear-resistant plate 10. The first wear-resistant plate 20 is disposed at an end of the fixed portion 2 adjacent to the movable scroll 1. An end of the first wear-resistant plate 20 facing the movable scroll 1 has the first bearing surface 2*a*. The wear-resistant ring 41 installed in the groove 3 of the movable scroll 1 is in contact with the first bearing surface 2*a* of the first wear-resistant plate 20. The second wear-resistant plate 10 is disposed at an end of the movable scroll 1 adjacent to the fixed portion 2. An end of the second wear-resistant plate 10 facing the fixed portion 2 has the second bearing surface 1*a*. The wear-resistant ring 41 installed in the groove 3 of the fixed portion 2 is in contact with the second bearing surface 1*a* of the second wear-resistant plate 10. In this embodiment, the grooves 3 are provided on both the movable scroll 1 and the fixed portion 2. In addition, each groove 3 is equipped with a sealing assembly 4 to achieve a double sealing effect and further improve the sealing performance of the back pressure chamber 100. In addition, by providing the first wear-resistant plate 20 and the second wear-resistant plate 10, during the rotation of the movable scroll 1 relative to the fixed portion 2, the wear-resistant ring 41 is in sliding contact with the first wear-resistant plate 20 or the second wear-resistant plate 10 instead of directly contacting the fixed portion 2 or the movable scroll 1, thereby avoiding the wear of the fixed portion 2 or the movable scroll 1. When the wear degree reaches a replacement condition, only the first wear-resistant plate 20 and/or the second wear-resistant plate 10 need to be replaced, and there is no need to replace the large parts such as the fixed portion 2 or the movable scroll 1, so that the maintenance cost is greatly reduced. In this embodiment, the arrangement of the first wear-resistant plate 20 and the second wear-resistant plate 10 is not specifically limited, they may be connected by a fastener, a pin, etc., or by bonding, clamping, etc. The remaining parts are the same as the case where the groove 3 is provided on the movable scroll 1, and will not be described here.

Figure 11:
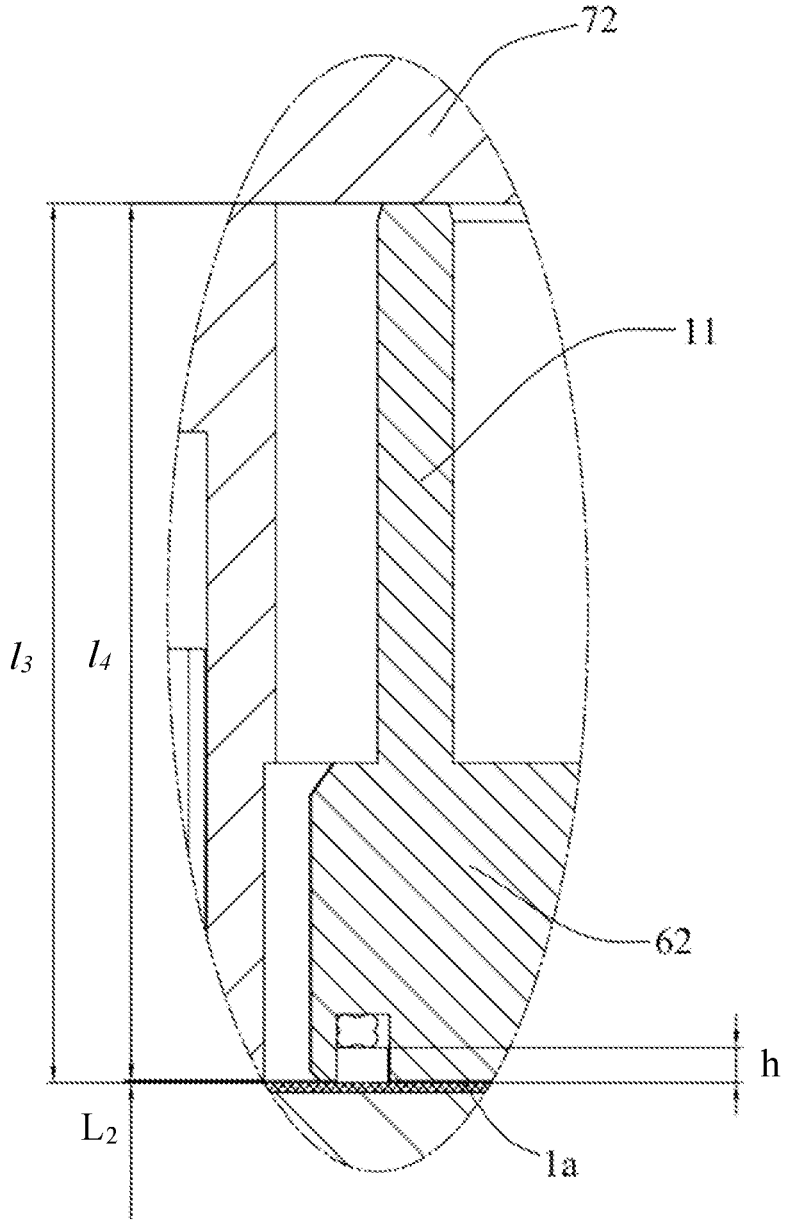
FIG. 11 is a partially enlarged view of circle D in FIG. 10.

In the above embodiment, a space 3*d* is formed between the wear-resistant ring 41 and the inner annular surface 3*b* of the groove 3, so that the pressure in the back pressure chamber 100 enters the first recess 421 through the space 3*d* between the wear-resistant ring 41 and the inner annular surface 3*b* of the groove 3, and then generates a pushing force on the elastic ring 42 toward the outer annular surface 3*c* of the groove 3, so that the elastic ring 42 expands to the outer peripheral side 42*b* and seals against the outer annular surface 3*c* of the groove 3, as shown in FIG. 11.

Figure 10:
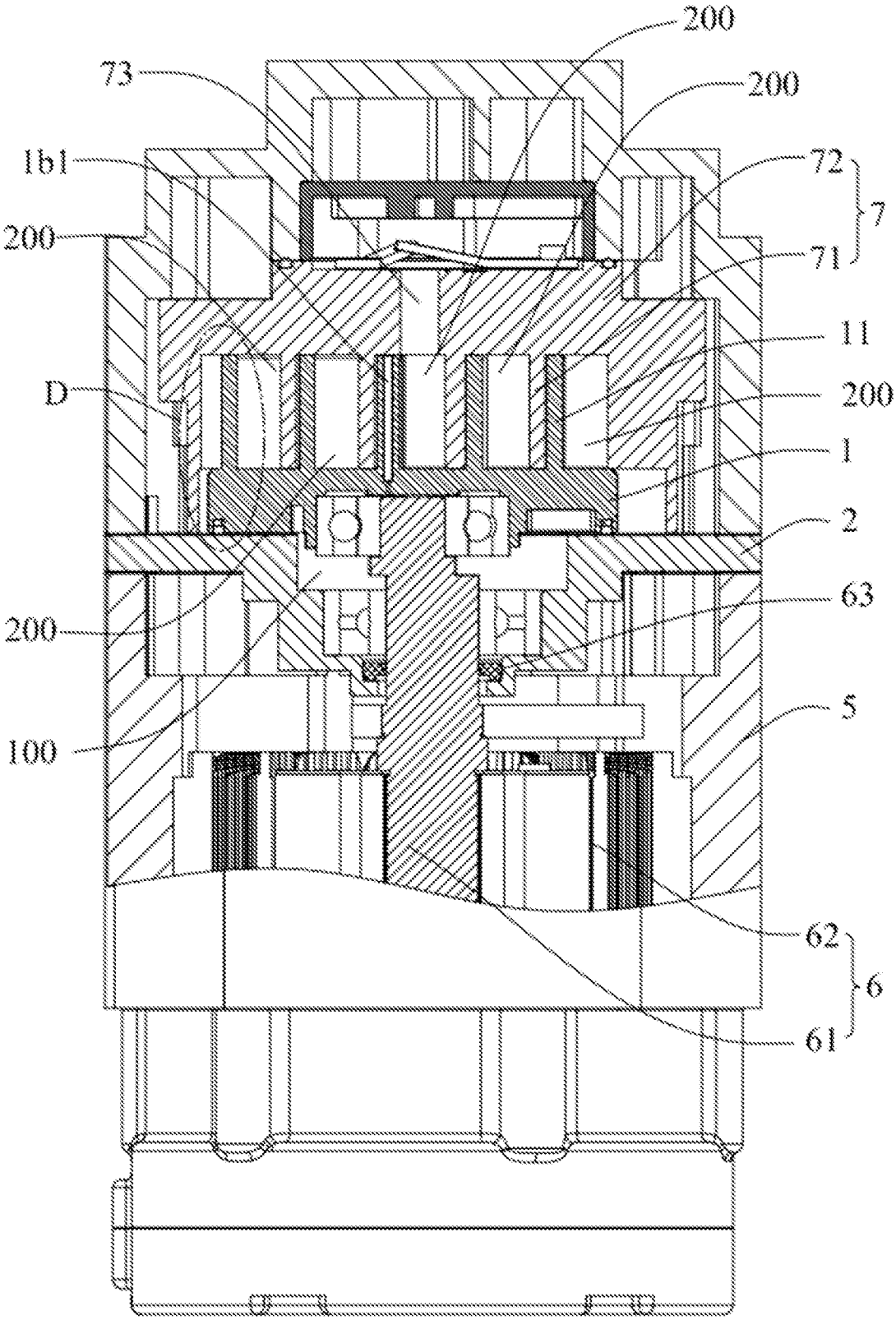
FIG. 10 is a structural view of the scroll compressor in accordance with an embodiment of the present disclosure.

Referring to FIG. 10 and FIG. 11, this embodiment further provides a scroll compressor, which includes a housing 5, a driving assembly 6 and a fixed scroll 7. The fixed portion 2 and the driving assembly 6 are at least partially installed in the housing 5. The driving assembly 6 includes a rotating shaft 61, a driving unit 62 and a bearing. The rotating shaft 61 is at least partly installed to the fixed portion 2 through the bearing. One end of the rotating shaft 61 is connected with the driving unit 62, and another end is eccentrically connected with the movable scroll 1. A first spiral wall 11 on the movable scroll 1 is in segmental contact with a second spiral wall 71 on the fixed scroll 7 so as to form a compression chamber 200.

When the driving unit 62 is configured to provide torque to the rotating shaft 61, the rotating shaft 61 drives the movable scroll 1 to rotate eccentrically around an axis of the rotating shaft 61, and then drives the first spiral wall 11 on the movable scroll 1 to mesh with the second spiral wall 71 on the fixed scroll 7. The medium is compressed in the compression chamber 200. The pressure of the medium increases in a direction from a radially outermost compression chamber 200 to a radially innermost compression chamber 200. The sealing assembly 4 abuts against the movable scroll 1 and the fixed portion 2, so as to seal the back pressure chamber 100 between the movable scroll 1 and the fixed portion 2. In this embodiment, the pressure of the medium in the compression chamber 200 increases, which will push the movable scroll 1 to move to the fixed portion 2. However, the pressure in the back pressure chamber 100 will produce an opposite thrust, pushing the movable scroll 1 to move towards the fixed scroll 7, so that the gap between the movable scroll 1 and the fixed scroll 7 will not be so large that the compressed medium will leak. And, during the floating process of the movable scroll 1 between the fixed scroll 7 and the fixed portion 2, an oil film is formed between an end surface adjacent to the second spiral wall 71 and the movable scroll 1, and between an end surface adjacent to the first spiral wall 11 and the fixed scroll 7 for sealing.

In the above-described embodiment, the fixed scroll 7 includes an end plate 72. An axial distance from one end of the end plate 72 adjacent to the movable scroll 1 to the second bearing surface 1*a* of the fixed portion 2 is $l_3$; an axial distance from a top end of the first spiral wall 11 of the movable scroll 1 to the second bearing surface 1*a* is $l_4$; where $l_3-l_4=L_2$. An axial thickness of the wear-resistant ring 41 is h, where $h>L_2$. This ensures that during the floating process of the movable scroll 1 between the fixed scroll 7 and the fixed portion 2, the wear-resistant ring 41 is always restricted in the groove 3, so that a problem of slippage of the wear-resistant ring 41 does not occur.

Figure 12:
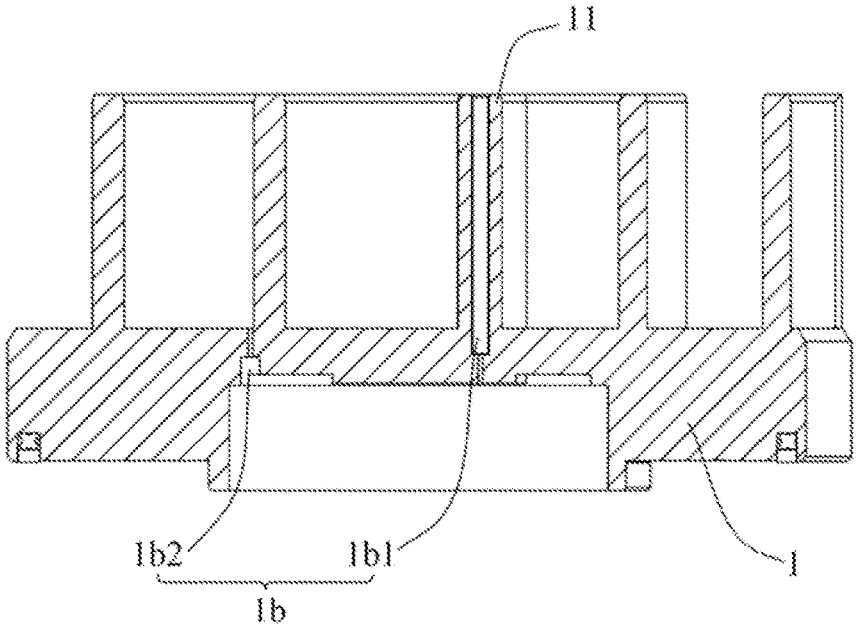
FIG. 12 is a partial view of the movable scroll in accordance with an embodiment of the present disclosure.

Referring to FIG. 10 again, and in conjunction with FIG. 12, further, the fixed scroll 7 is provided with a gas outlet port 73. The gas outlet port 73 communicates with the radially innermost compression chamber 200, and a shaft seal 63 is provided between the rotating shaft 61 and the fixed portion 2.

In the above embodiments, the movable scroll 1 is provided with a pressure introduction hole 1*b*. The pressure introduction hole 1*b* includes a gas inlet hole 1*b*1 and a gas outlet hole 1*b*2. One end of the gas inlet hole 1*b*1 is intermittently communicated with the gas outlet port 73, and another end of the gas inlet hole 1*b*1 is communicated with the back pressure chamber 100. One end of the gas outlet hole 1*b*2 is communicated with a compression chamber 200 located radially outside the central compression chamber 200, and another end of the gas outlet hole 1*b*2 is communicated with the back pressure chamber 100. By providing the gas inlet hole 1*b*1 and the gas outlet hole 1*b*2 on the movable scroll 1, the high-pressure medium in the compression chamber 200 can enter the back pressure chamber 100 through the gas inlet hole 1*b*1. Moreover, the medium in the compression chamber 200 can also enter the compression chamber 200 with lower pressure from the gas outlet hole 1*b*2 to be compressed again. In this embodiment, by providing the pressure introduction hole 1*b*, the pressure on two sides of the movable scroll 1 in an axial direction can be automatically adjusted through the gas inlet hole 1*b*1 and the gas outlet hole 1*b*2 to be maintained in a relatively balanced state, preventing a situation that the compressed medium leaks due to the separation of the movable scroll 1 and the fixed scroll 7. In this embodiment, a gas inlet port of the gas inlet hole 1*b*1 is disposed on the first spiral wall 11.

Figure 13:
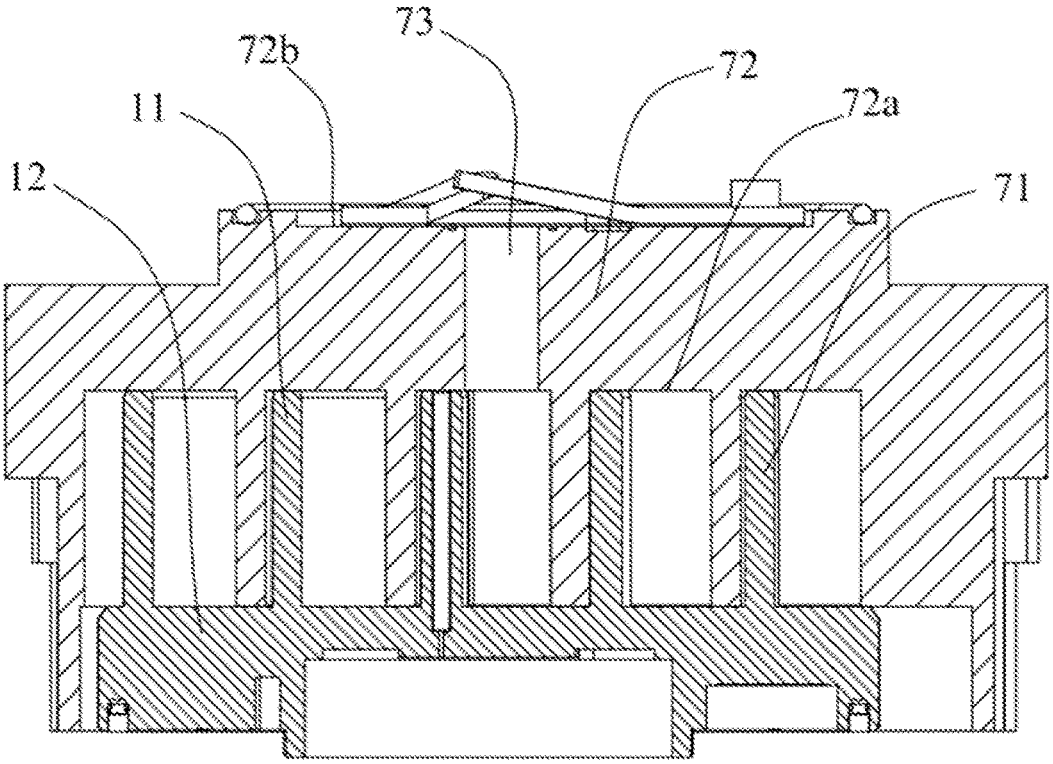
FIG. 13 is a structural view of the fixed scroll and the movable scroll mated with each other in accordance with an embodiment of the present disclosure.
Figure 14:
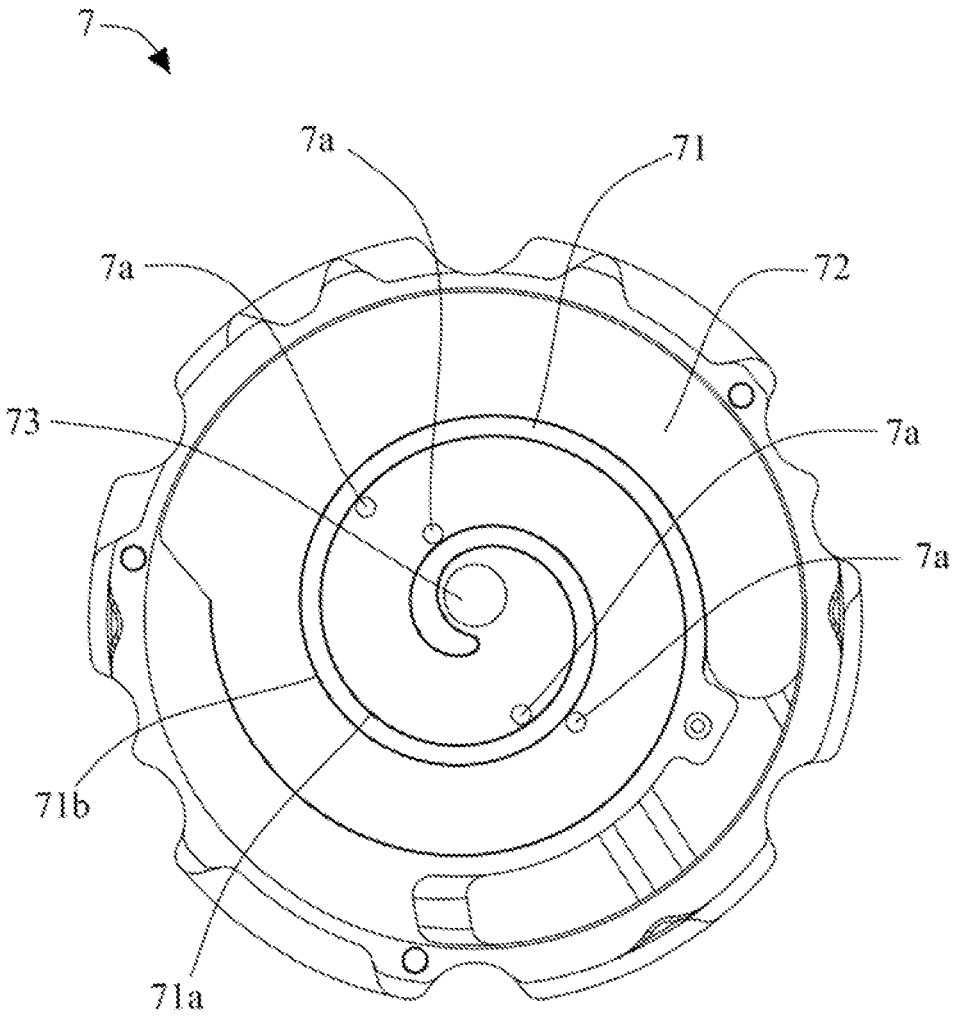
FIG. 14 is a structural view of the fixed scroll in the present embodiment.
Figure 15:
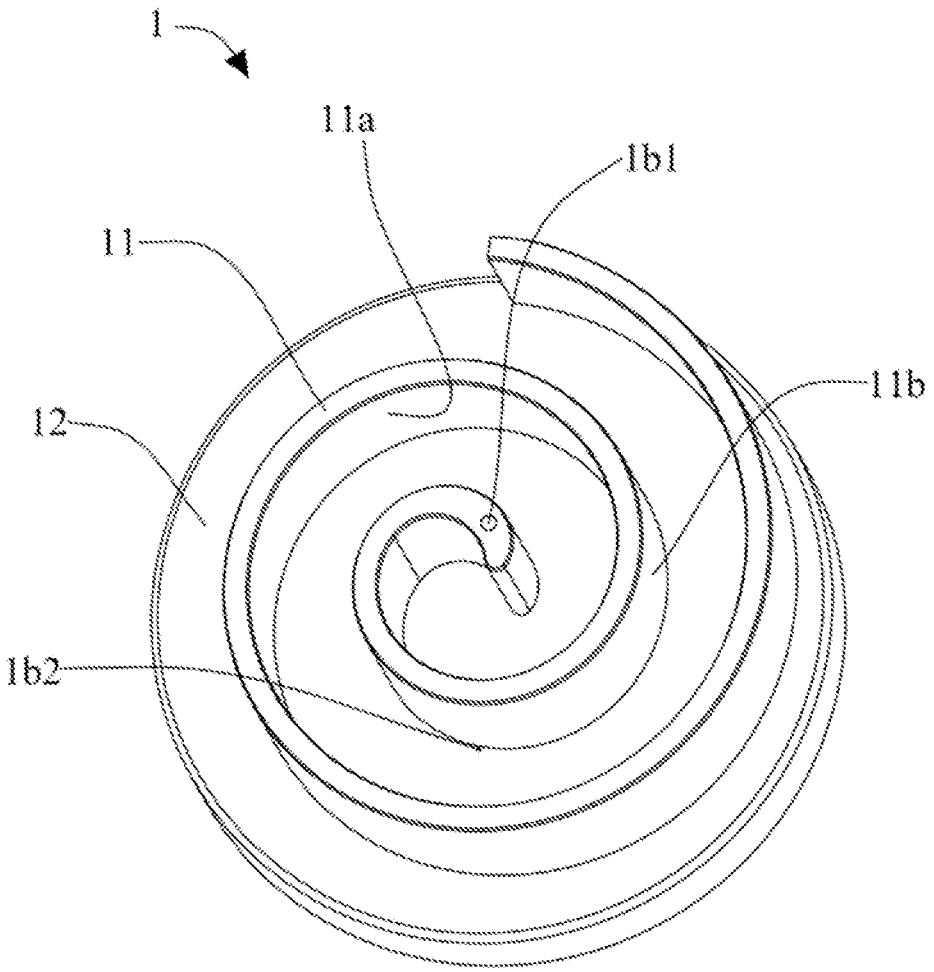
FIG. 15 is a structural view of the movable scroll in the present embodiment.

Referring to FIGS. 13 to 15, in the above embodiments, the movable scroll 1 includes the first spiral wall 11 and a fixing plate 12. A root of the first spiral wall 11 is connected to the fixing plate 12. The fixed scroll 7 includes the second spiral wall 71 and the end plate 72. The root of the second spiral wall 71 is connected to the end plate 72. The fixing plate 12 and the end plate 72 are disposed oppositely. The top end of the first spiral wall 11 is in contact with the end plate 72. A top end of the second spiral wall 71 is in contact with the fixing plate 12. The first spiral wall 11 is in contact with the second spiral wall 71 to form a plurality of compression chambers 200. In this embodiment, the compression chambers 200 are closed chambers. There are two contact points between the first spiral wall 11 and the second spiral wall 71 in each compression chamber 200.

Figure 16:
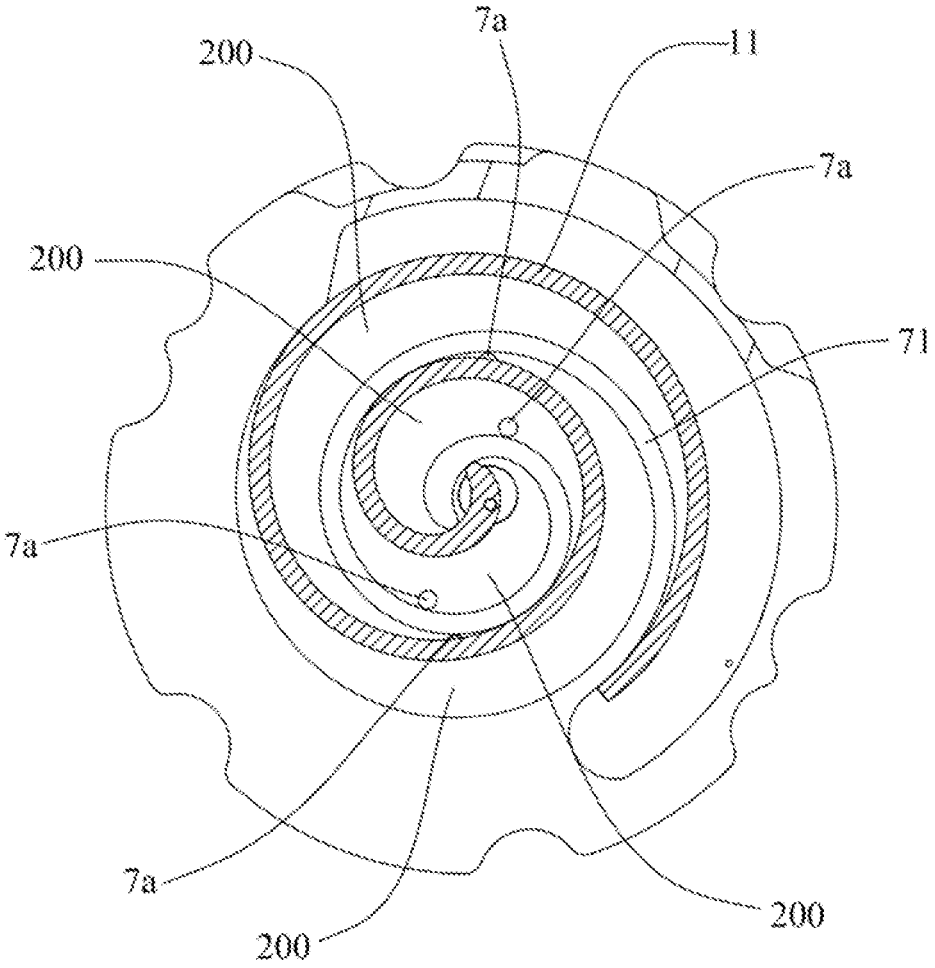
FIG. 16 is a view of a structure when an end point of a first inner wall is in contact with a second outer wall in the present embodiment.

The first spiral wall 11 includes a first inner wall surface 11*a* and a first outer wall surface 11*b*. The second spiral wall 71 includes a second inner wall surface 71*a* and a second outer wall surface 71*b*. The end plate 72 is provided with at least one anti-liquid shock hole 7*a*. The movable scroll 1 and the fixed scroll 7 are important components of the scroll compressor. The liquid shock phenomenon will seriously damage the movable scroll 1 and the fixed scroll 7, resulting in reduced compression performance and compression effect, and the noise and vibration generated at the same time will also reduce the user experience. Therefore, in this embodiment, when an end point of a profile line of the first inner wall surface 11*a* is in contact with the second outer wall surface 71*b* (as shown in FIG. 16), at least part of the compression chamber 200 communicates with the at least one anti-liquid shock hole 7*a*. Wet vapor or liquid refrigerant can be discharged from the compression chamber 200 through the anti-liquid shock hole 7*a*, reducing or preventing the occurrence of liquid shock, so as to prolong the service life of the scroll compressor, and reduce vibration and noise. In addition, the gas outlet port 73 is also disposed on the end plate 72, and the gas outlet port 73 extends through the end plate 72. The gas outlet port 73 communicates at least partially with the centrally located compression chamber 200. The refrigerant is compressed from outside to inside through the compression chamber 200 to form a high pressure, and finally discharged from the gas outlet port 73.

In this embodiment, when the end point of the first inner wall surface 11*a* is in contact with the second outer wall surface 71*b*, other compression chambers 200 except the central compression chamber 200 communicate with a corresponding anti-liquid shock hole 7*a*. When the end point of the first inner wall surface 11*a* is in contact with the second outer wall surface 71*b*, that is, during the eccentric rotation of the movable scroll 1 around the fixed scroll 7, as soon as a suction port formed by the movable scroll 1 and the fixed scroll 7 is closed, and as soon as the outermost compression chamber 200 is formed, the anti-liquid shock hole 7*a* communicates with the outermost compression chamber 200. When the refrigerant enters the compression chamber 200 in wet vapor or liquid state, the wet vapor or liquid refrigerant can be discharged through the anti-liquid shock hole 7*a* communicating with the outermost compression chamber 200. Even if all the refrigerant in the liquid state enters the compression chamber 200, it can be discharged from the anti-liquid shock hole 7*a*, reducing or avoiding the liquid shock phenomenon caused by further compression. As a result, the movable scroll 1 and the fixed scroll 7 are not damaged, the movable scroll 1 and the fixed scroll 7 are effectively protected, and the effects of prolonging the service life of the scroll compressor and reducing vibration and noise are achieved.

Referring to FIG. 15 and FIG. 16, along the profile line of the first inner wall surface 11*a*, in a direction from an end point $O_0$ to a starting point $O'_0$, the compression chambers 200 except the central compression chamber 200 include two adjacent first intersection points of the first inner wall surface 11*a* and the second outer wall surface 71*b*, or include two adjacent second intersection points of the first outer wall surface 11*b* and the second inner wall surface 71*a*. The anti-liquid shock hole 7*a* is located between the two adjacent first intersection points or between the two adjacent second intersection points. Wherein, along the profile line of the first inner wall surface 11*a*, in the direction from the end point $O_0$ to the starting point $O'_0$, the first intersection points include $O_1$, $O'_1$, . . . , and the second intersection points include $O_2$, $O'_2$, . . . .

Figure 17A:
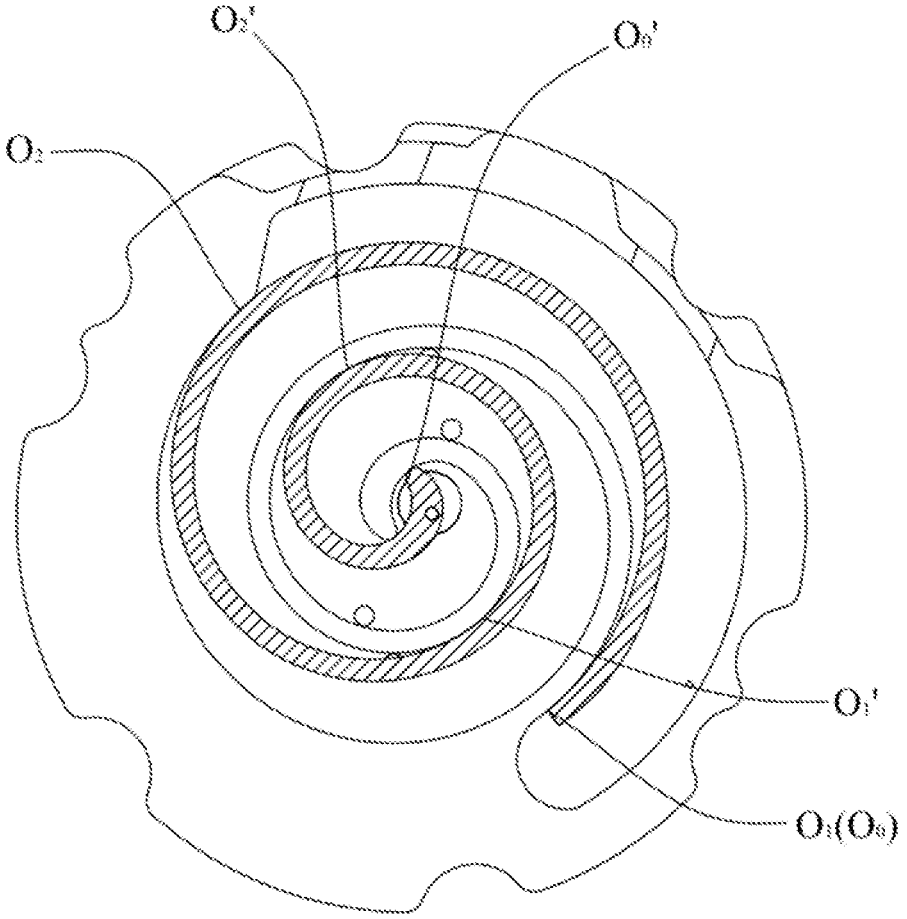
FIG. 17*a* is a view of the end point of the first inner wall surface in contact with the second outer wall surface in the present embodiment.
Figure 17B:
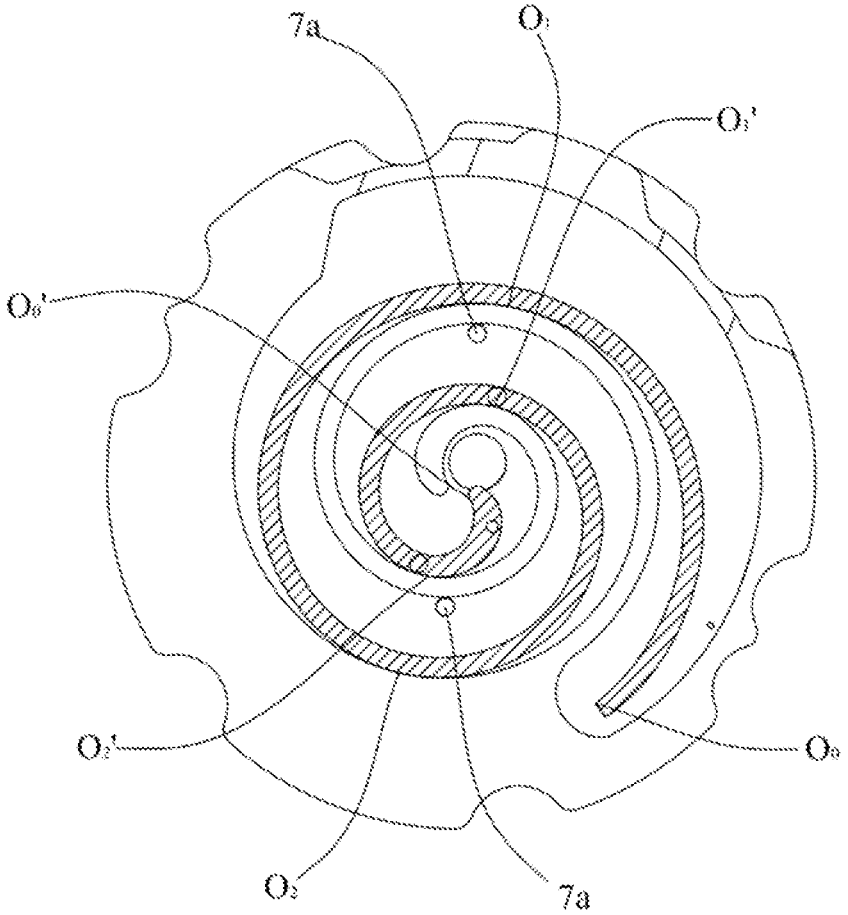
FIG. 17*b* is a view when the end point of the first inner wall is not in contact with the second outer wall in the present embodiment.

Referring to FIG. 16 again, and in conjunction with FIG. 17*a*, when the end point of the first inner wall surface 11*a* is in contact with the second outer wall surface 71*b*, the anti-liquid shock hole 7*a* communicated with the outermost compression chamber 200 is located at the first intersection point $O_1$ or the second intersection point $O_2$ adjacent to the starting point $O'_0$. Alternatively, the anti-liquid shock hole 7*a* communicated with the outermost compression chamber 200 is located adjacent to the first intersection point $O_1$ or the second intersection point $O_2$ close to the starting point $O'_0$. As soon as the suction port formed by the movable scroll 1 and the fixed scroll 7 is closed, and as soon as the outermost compression chamber 200 is formed, part of the anti-liquid shock hole 7*a* communicates with the outermost compression chamber 200. As the compression chamber 200 continues to compress, the anti-liquid shock hole 7*a* here is completely located in the compression chamber 200, as shown in FIG. 17*b*. Through such a design, the working time of the anti-liquid shock hole 7*a* is extended, and the wet vapor or liquid refrigerant is discharged through the anti-liquid shock hole 7*a* as much as possible, so as to achieve the effect of preventing liquid shock. At the same time, it is avoided that the structural strength of the end plate 72 is affected due to too many anti-liquid shock holes 7*a* being provided on the end plate 72.

Furthermore, in this embodiment, the number of spiral turns of the first spiral wall 11 and the second spiral wall 71 is the same, which is n. The number of the anti-liquid shock holes 7*a* is 2n. Specifically, the first spiral wall 11 and the second spiral wall 71 have the same structure, but different starting angles. During the eccentric rotation of the movable scroll 1 around the fixed scroll 7, the first spiral wall 11 is in segmental contact with the second spiral wall 71. In the present embodiment, n is 2. There are four anti-liquid shock holes 7*a*, two of which are located adjacent to the root of the second inner wall surface 71*a*, and another two of which are located adjacent to the root of the second outer wall surface 71*b*. In addition, the two anti-liquid shock holes 7*a* located adjacent to the central compression chamber 200 also have the function of discharging gas in advance.

Figure 18:
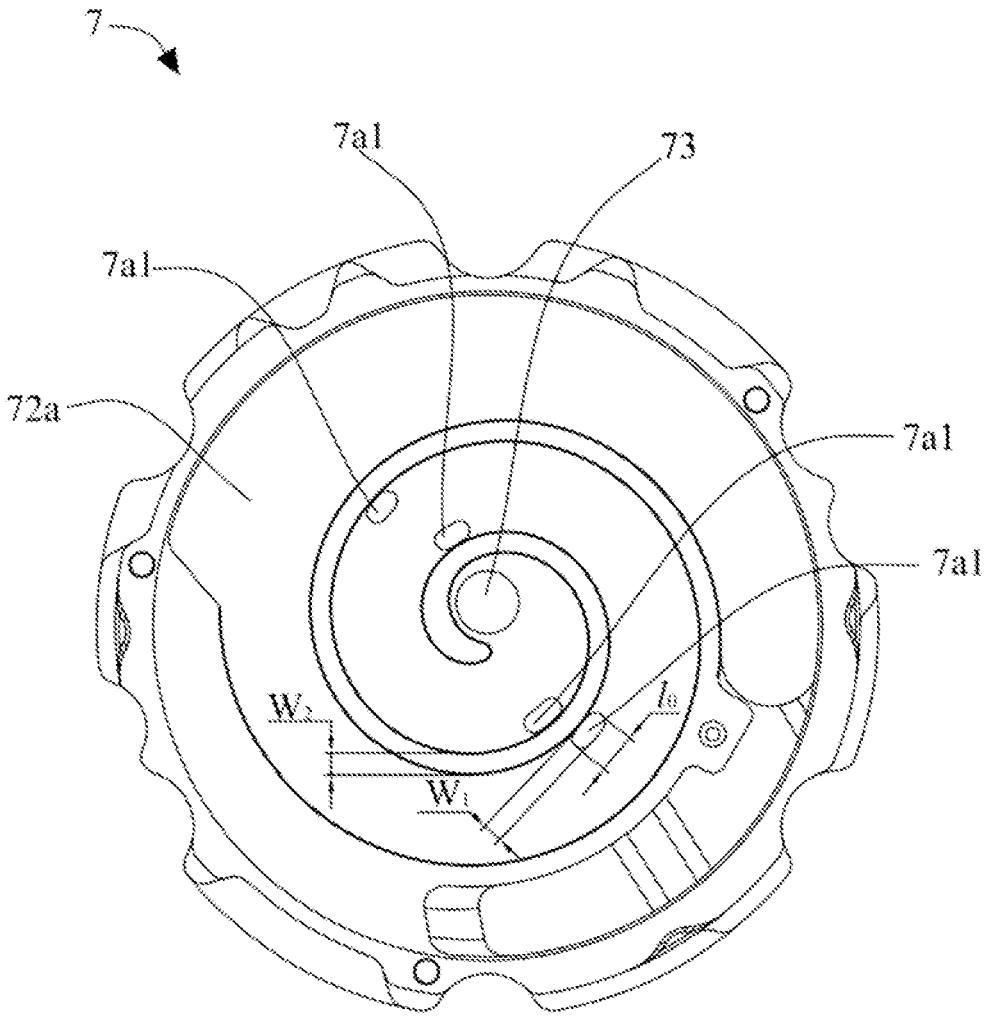
FIG. 18 is a view of a waist-shaped opening at one end of the anti-liquid shock hole in the present embodiment.
Figure 19:
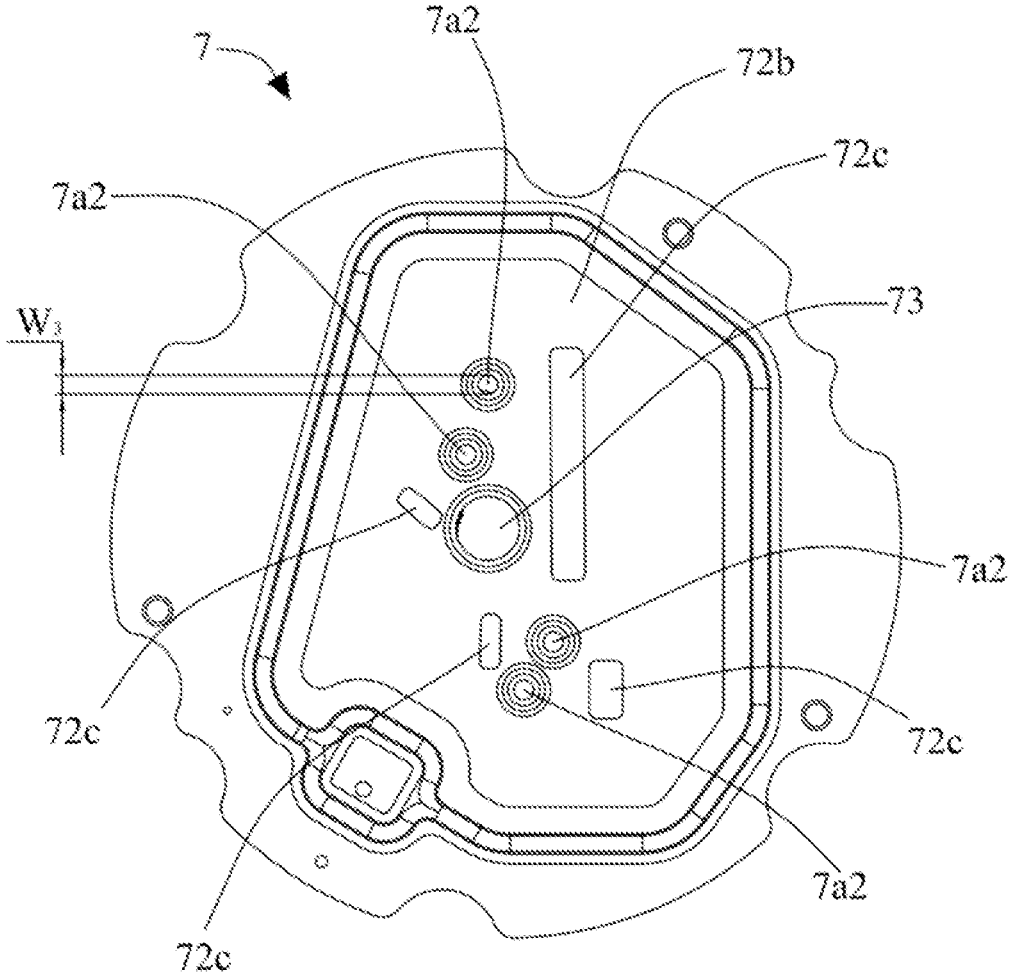
FIG. 19 is a structural view of a second surface of the fixed scroll in the present embodiment.

Referring to FIG. 18 and FIG. 19, in conjunction with FIG. 13, in the above embodiment, the end plate 72 includes a first surface 72*a* which is connected to the second spiral wall 71. The anti-liquid shock hole 7*a* includes a first port 7*al*. A shape of the first port 7*a*1 on the first surface 72*a* is in a shape of a waist-shaped opening. Specifically, a length of the first port 7*a*1 is $l_0$; a width of the first port 7*a*1 is $W_1$, where $l_0>W_1$. By designing the first port 7*a*1 on a side of the anti-liquid shock hole 7*a* adjacent to the compression chamber 200 as the waist-shaped opening, the length of the first port 7*a*1 along a profile direction of the first inner wall surface 11*a* is increased. As soon as the suction port formed by the movable scroll 1 and the fixed scroll 7 is closed, and as soon as the outermost compression chamber 200 is formed, the first port 7*a*1 in the form of the waist-shaped opening can communicate with the outermost compression chamber 200 in a relatively large area. The liquid refrigerant sucked into the compression chamber 200 can be discharged through the first port 7*al*, which enhances the discharge effect of the liquid refrigerant. Wherein, a length direction of the first port 7*a*1 extends equidistantly along the profile direction of the second spiral wall 71 at the junction. A wall thickness of the second spiral wall 71 is W2, where W1≤W2, so as to prevent two radially adjacent compression chambers 200 with different pressures from communicating. In addition, the end plate 72 includes a second surface 72*b* which is disposed opposite to the first surface 72*a*. The anti-liquid shock hole 7*a* includes a second port 7*a*2. A shape of the second port 7*a*2 on the second surface 72*b* is circular. A diameter of the second port 7*a*2 is W3, where W3≤W1.

Figure 20:
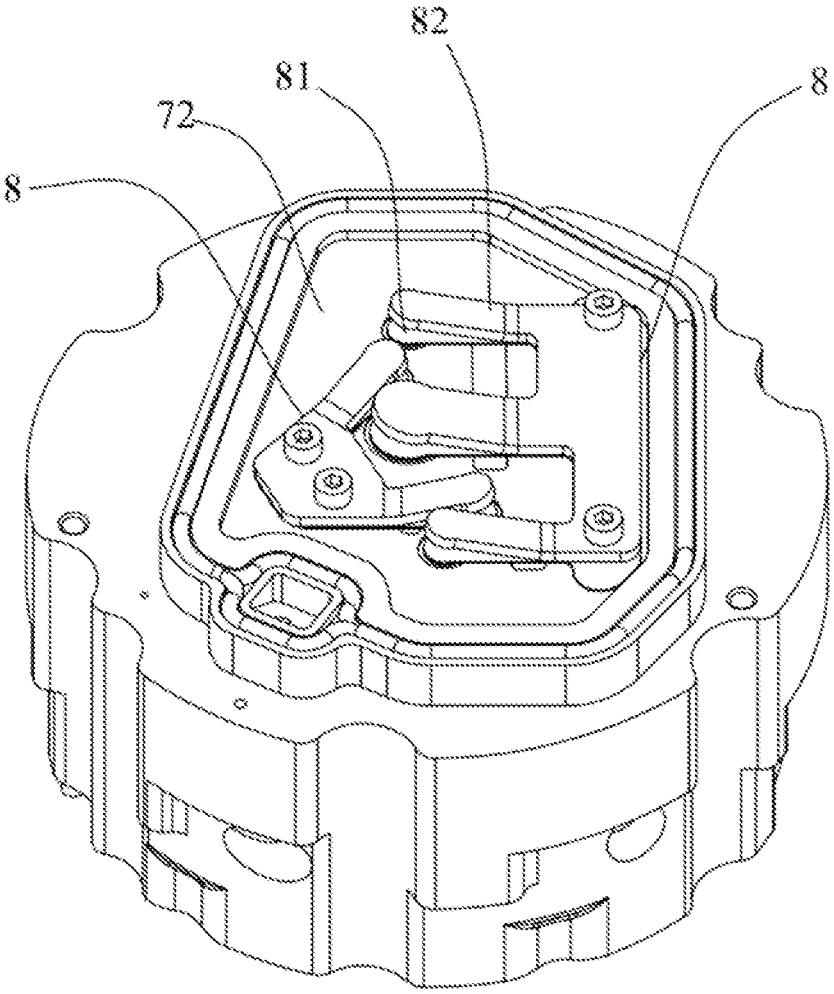
FIG. 20 is a structural view of a valve plate installed on the fixed scroll in the present embodiment.
Figure 21:
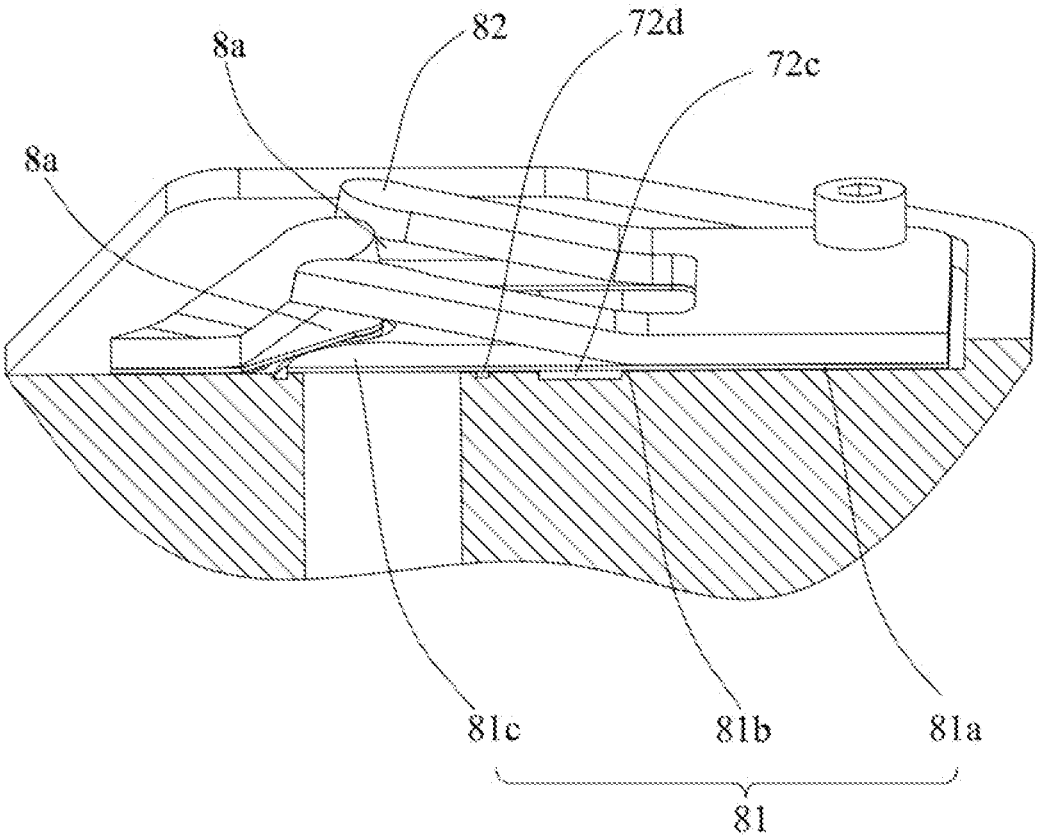
FIG. 21 is a view of a partial structure of the fixed scroll with the valve plate installed in the present embodiment.

Referring to FIG. 20 and FIG. 21, in conjunction with FIG. 19, in the above embodiment, the scroll compressor further includes a valve plate 8. The valve plate 8 is installed on an end of the end plate 72 away from the compression chamber 200. In the embodiment of the present disclosure, at least two groups of valve plates 8 are provided. Each group of valve plates 8 are capable of controlling the on-off of at least two anti-liquid shock holes 7*a*, and one group of valve plates 8 is also capable of controlling the on-off of the gas outlet port 73.

Furthermore, the valve plate 8 includes a leaf spring 81 and a lift limiter 82. The leaf spring 81 is located between lift limiter 82 and end plate 72. Along an axial direction of the end plate 72, a lift gap 8*a* is formed between the anti-liquid shock hole 7*a* and the lift limiter 82, and a lift gap 8*a* is formed between the gas outlet port 73 and the lift limiter 82. The leaf spring 81 includes a fixing portion 81*a*, a connecting portion 81*b* and an end portion 81*c*. The connecting portion 81*b* connects the fixing portion 81*a* and the end portion 81*c*. The fixing portion 81*a* is fixed between the lift limiter 81 and the end plate 72. The end portion 81*c* is located in the lift gap 8*a*. By providing the valve plate 8, the liquid refrigerant discharged through the anti-liquid shock hole 7*a* and the gas refrigerant discharged through the gas outlet port 73 are prevented from flowing back into the compression chamber 200. In this embodiment, two groups of valve plates 8 are provided, in which one group of valve plates 8 are capable of controlling the on-off of the gas outlet port 73 and the two anti-liquid shock holes 7*a* away from the central compression chamber 200, and the other group of valve plates 8 are capable of controlling the on-off of the two anti-liquid shock holes 7*a* adjacent to the central compression chamber 200. That is, the gas outlet port 73 and the two anti-liquid shock holes 7*a* away from the central compression chamber 200 at the center share one group of valve plates 8; and the two anti-liquid shock holes 7*a* adjacent to the central compression chamber 200 share the other group of valve plates 8, thereby making the structure compact. In this embodiment, the fixing portion 81*a* is connected with the lift limiter 82 and the end plate 72 by fasteners. By designing two groups of valve plates 8, it is possible to avoid reducing the structural strength of the end plate 72 due to too many mounting holes for the fasteners. In this embodiment, the fixing portion 81*a*, the lift limiter 82 and the end plate 72 may be connected by welding, bonding, clamping, etc., in addition to being connected by fasteners. In this embodiment, the liquid refrigerant discharged through the anti-liquid shock hole 7*a* will be mixed with part of the gaseous refrigerant.

Furthermore, the end plate 72 is provided with a slot 72*c* at a position corresponding to the connecting portion 81*b*. A contact surface between the reed 81 and the end plate 72 is reduced by the slot 72*c*, which avoids the unevenness of an end surface of the end plate 72 due to the influence of machining accuracy. As a result, a problem of leakage due to the poor closure of the leaf spring 81 caused by a surface of the end plate 72 pushing up the leaf spring 81 is avoided. In addition, the end plate 72 is provided with an annular groove 72*d* on an outer periphery of the anti-liquid shock hole 7*a* and/or the gas outlet port 73, which also solves the problem that the closure of the leaf spring 81 is affected by the machining accuracy.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A scroll compressor, configured to compress a medium, comprising a movable scroll and a fixed portion, the movable scroll cooperating with the fixed portion, the fixed portion having a first bearing surface, the movable scroll having a second bearing surface;

wherein the scroll compressor comprises a back pressure chamber located between the movable scroll and the fixed portion; at least one of the movable scroll and the fixed portion is provided with a groove disposed on a periphery of the back pressure chamber; the scroll compressor further comprises a sealing assembly at least partially installed in the groove; one end of the sealing assembly is in contact with a groove bottom surface in the groove;

another end of the sealing assembly at least partially located in the groove of the movable scroll is in contact with the first bearing surface of the fixed portion, and/or another end of the sealing assembly at least partially located in the groove of the fixed portion is in contact with the second bearing surface of the movable scroll;

the sealing assembly comprises a wear-resistant ring and an elastic ring; the groove comprises an inner annular surface and an outer annular surface along the width direction of the groove; a diameter of the outer annular surface is larger than a diameter of the inner annular surface; a space is formed between the wear-resistant ring and the inner annular surface of the groove; the back pressure chamber is configured to be in communication with the groove via the space;

the wear-resistant ring and the elastic ring are at least partially stacked along a depth direction of the groove; the width direction of the groove is perpendicular to the depth direction of the groove; and the elastic ring is provided with at least one recess on a surface thereof; the at least one recess comprises a first recess; the first recess is in communication with the back pressure chamber via the space;

when the first recess is subjected to pressure from the back pressure chamber through the space, a pushing force is generated through the medium; the pushing force acts on the elastic ring and expands the elastic ring; the elastic ring is then driven by the pushing force to more tightly contact with the groove bottom surface and the wear-resistant ring.

2. The scroll compressor according to claim 1, wherein the first recess is annularly distributed along a central axis of the elastic ring, or the first recess is arc-shaped and distributed in a circular array along a central axis of the elastic ring; a direction of the central axis of the elastic ring is parallel to the depth direction of the groove;

when the elastic ring is not subjected to pressure along the depth direction of the groove, a gap is formed between the elastic ring and the inner annular surface and/or a gap is formed between the elastic ring and the outer annular surface.

3. The scroll compressor according to claim 2, wherein the elastic ring has an inner peripheral side and an outer peripheral side along the width direction of the groove; a diameter of the inner peripheral side is smaller than a diameter of the outer peripheral side; the first recess is located on the inner peripheral side of the elastic ring; at least part of an opening of the first recess faces the inner annular surface of the groove;

the opening of the first recess at least partially communicates with the back pressure chamber;

the elastic ring is installed in the groove, and the elastic ring is located between the wear-resistant ring and the groove bottom surface; the wear-resistant ring is at least partially installed in the groove; along the depth direction of the groove, the elastic ring comprises a first end surface and a second end surface; one end of the wear-resistant ring is in contact with the first end surface of the elastic ring, and another end of the wear-resistant ring is in contact with the second bearing surface or the first bearing surface; the second end surface of the elastic ring is in contact with the groove bottom surface;

a friction coefficient between the wear-resistant ring and the elastic ring is greater than a friction coefficient between the wear-resistant ring and the first bearing surface or a friction coefficient between the wear-resistant ring and the second bearing surface; and a friction coefficient between the elastic ring and the groove bottom surface is greater than the friction coefficient between the wear-resistant ring and the first bearing surface or the friction coefficient between the wear-resistant ring and the second bearing surface.

4. The scroll compressor according to claim 3, wherein the elastic ring is located in the groove and separates the groove into an inner space and an outer space along the width direction of the groove; the at least one recess comprises a second recess provided on the outer peripheral side of the elastic ring; the second recess is disposed opposite to the first recess; the second recess is exposed to the outer space; the elastic ring comprises a first outer edge and a second outer edge which are disposed on two opposite sides of the second recess along the depth direction of the groove; when the first recess is subjected to pressure from the back pressure chamber through the space, the pushing force acts on the elastic ring along the width direction of the groove; the elastic ring then compresses the outer space along the width direction of the groove so that the first outer edge and the second outer edge can be sealed against the outer annular surface of the groove;

the second recess is annularly distributed along the central axis of the elastic ring, or the second recess is arc-shaped and distributed in the circular array along the central axis of the elastic ring; or the second recess is spirally distributed along the central axis of the elastic ring.

5. The scroll compressor according to claim 3, wherein the at least one recesses further comprises a third recess provided on at least one of the first end surface and the second end surface of the elastic ring; the third recess is annularly distributed along the central axis of the elastic ring, or the third recess is arc-shaped and distributed in the circular array along the central axis of the elastic ring.

6. The scroll compressor according to claim 1, wherein when the elastic ring is not subjected to pressure along the depth direction of the groove, a maximum dimension of the elastic ring along the depth direction of the groove is $l_1$; a dimension of the wear-resistant ring along the depth direction of the groove is $l_2$; a sum of $l_1$ and $l_2$ is $L_1$; a depth of the groove is d, where $L_1>d$.

7. The scroll compressor according to claim 6, wherein the elastic ring is an elastomer, and the wear-resistant ring is a non-elastomer;

the elastic ring is made of rubber;

a material of the wear-resistant ring comprises any one of modified polytetrafluoroethylene, polyphenylene sulfide, polyether ether ketone, polyoxymethylene resin, and polyimide plastic.

8. The scroll compressor according to claim 1, wherein the fixed portion comprises a first wear-resistant plate which is disposed at an end of the fixed portion adjacent to the movable scroll; an end of the first wear-resistant plate facing the movable scroll has the first bearing surface; the wear-resistant ring is in contact with the first bearing surface of the first wear-resistant plate;

and/or, the movable scroll comprises a second wear-resistant plate which is disposed at an end of the movable scroll adjacent to the fixed portion; an end of the second wear-resistant plate facing the fixed portion has the second bearing surface; and the wear-resistant ring is in contact with the second bearing surface of the second wear-resistant plate.

9. The scroll compressor according to claim 1, further comprising a housing, a driving assembly and a fixed scroll; the fixed portion and the driving assembly being at least partially installed in the housing; the driving assembly comprising a rotating shaft, a driving unit and a bearing; the rotating shaft being at least partly installed on the fixed portion through the bearing; one end of the rotating shaft being connected to the driving unit, and another end of the rotating shaft being eccentrically connected to the movable scroll; a first spiral wall on the movable scroll being in contact with a second spiral wall on the fixed scroll to form a compression chamber; the sealing assembly being resisted against the movable scroll and the fixed portion so as to seal the back pressure chamber between the movable scroll and the fixed portion.

10. The scroll compressor according to claim 9, wherein the fixed scroll comprises an end plate; an axial distance from the end plate adjacent to the movable scroll to the second bearing surface is $l_3$; an axial distance from a top end of the first spiral wall of the movable scroll to the second bearing surface is $l_4$, where $l_3-l_4=L_2$; an axial thickness of the wear-resistant ring is h, where $h>L_2$;

the fixed scroll is provided with a gas outlet port which communicates with a radially innermost compression chamber;

the movable scroll is provided with a pressure introduction hole; the pressure introduction hole comprises a gas inlet hole and a gas outlet hole; one end of the gas inlet hole is intermittently communicated with the gas outlet port, and another end of the gas inlet hole is communicated with the back pressure chamber; one end of the gas outlet hole is communicated with the compression chamber located radially outside a central compression chamber, and another end of the gas outlet hole is communicated with the back pressure chamber; and a shaft seal is disposed between the rotating shaft and the fixed portion.

11. A scroll compressor, comprising:

a fixed portion having a first bearing surface;

a movable scroll having a second bearing surface facing the first bearing surface; the movable scroll being rotatable with respect to the fixed portion;

a fixed scroll at least partially covering the movable scroll to form a compression chamber between the fixed scroll and the movable scroll;

a back pressure chamber formed by the movable scroll and the fixed portion; and a sealing assembly comprising a wear-resistant ring and an elastic ring;

wherein at least one of the movable scroll and the fixed portion is provided with a groove disposed on a periphery of the back pressure chamber; the sealing assembly is at least partially installed in the groove; one end of the sealing assembly is in contact with an abutting surface in the groove along a depth direction of the groove; another end of the sealing assembly at least partially located in the groove of the movable scroll is in contact with the first bearing surface and/or another end of the sealing assembly at least partially located in the groove of the fixed portion is in contact with the second bearing surface along the depth direction of the groove;

the wear-resistant ring and the elastic ring are at least partially stacked along the depth direction of the groove;

the elastic ring is provided with at least one recess on a surface thereof so as to enhance an elastic performance thereof; the at least one recess comprises a first recess which is in communication with the back pressure chamber; and the movable scroll defines a pressure introduction hole through which the compression chamber and the back pressure chamber are in communication with each other.

12. The scroll compressor according to claim 11, wherein the first recess is annularly distributed along a central axis of the elastic ring, or the first recess is arc-shaped and distributed in a circular array along a central axis of the elastic ring; a direction of the central axis of the elastic ring is parallel to the depth direction of the groove;

along a width direction of the groove, the groove comprises an inner annular surface and an outer annular surface; a diameter of the outer annular surface is larger than a diameter of the inner annular surface; the width direction of the groove is perpendicular to the depth direction of the groove;

a space is formed between the wear-resistant ring and the inner annular surface of the groove;

when the elastic ring is not subjected to pressure along the depth direction of the groove, a gap is formed between the elastic ring and the inner annular surface and/or a gap is formed between the elastic ring and the outer annular surface.

13. The scroll compressor according to claim 12, wherein the elastic ring has an inner peripheral side and an outer peripheral side along the width direction of the groove; a diameter of the inner peripheral side is smaller than a diameter of the outer peripheral side; the first recess is located on the inner peripheral side of the elastic ring; at least part of an opening of the first recess faces the inner annular surface of the groove;

the opening of the first recess at least partially communicates with the back pressure chamber;

the elastic ring is installed in the groove, and the elastic ring is located between the wear-resistant ring and the abutting surface; the wear-resistant ring is at least partially installed in the groove; along the depth direction of the groove, the elastic ring comprises a first end surface and a second end surface; one end of the wear-resistant ring is in contact with the first end surface of the elastic ring, and another end of the wear-resistant ring is in contact with the second bearing surface or the first bearing surface; the second end surface of the elastic ring is in contact with the abutting surface;

a friction coefficient between the wear-resistant ring and the elastic ring is greater than a friction coefficient between the wear-resistant ring and the first bearing surface or a friction coefficient between the wear-resistant ring and the second bearing surface; and a friction coefficient between the elastic ring and the abutting surface is greater than the friction coefficient between the wear-resistant ring and the first bearing surface or the friction coefficient between the wear-resistant ring and the second bearing surface.

14. The scroll compressor according to claim 13, wherein the elastic ring is located in the groove and separates the groove into an inner space and an outer space along the width direction of the groove; the at least one recess comprises a second recess provided on the outer peripheral side of the elastic ring; the second recess is exposed to the outer space; the elastic ring comprises a first outer edge and a second outer edge which are disposed on two opposite sides of the second recess along the depth direction of the groove; when the first recess is subjected to pressure from the back pressure chamber through the space, a pushing force is generated through a medium and acts on the elastic ring along the width direction of the groove; the elastic ring then compresses the outer space along the width direction of the groove so that the first outer edge and the second outer edge can be sealed against the outer annular surface of the groove;

the second recess is annularly distributed along the central axis of the elastic ring, or the second recess is arc-shaped and distributed in the circular array along the central axis of the elastic ring; or the second recess is spirally distributed along the central axis of the elastic ring.

15. The scroll compressor according to claim 13, wherein the at least one recesses further comprises a third recess provided on at least one of the first end surface and the second end surface of the elastic ring; the third recess is annularly distributed along the central axis of the elastic ring, or the third recess is arc-shaped and distributed in the circular array along the central axis of the elastic ring.

16. The scroll compressor according to claim 11, wherein when the elastic ring is not subjected to pressure along the depth direction of the groove, a maximum dimension of the elastic ring along the depth direction of the groove is $l_1$; a dimension of the wear-resistant ring along the depth direction of the groove is $l_2$; a sum of $l_1$ and $l_2$ is $L_1$; a depth of the groove is d, where $L_1>d$.

17. The scroll compressor according to claim 16, wherein the elastic ring is an elastomer, and the wear-resistant ring is a non-elastomer;

the elastic ring is made of rubber;

a material of the wear-resistant ring comprises any one of modified polytetrafluoroethylene, polyphenylene sulfide, polyether ether ketone, polyoxymethylene resin, and polyimide plastic.

18. The scroll compressor according to claim 11, wherein the fixed portion comprises a first wear-resistant plate which is disposed at an end of the fixed portion adjacent to the movable scroll; an end of the first wear-resistant plate facing the movable scroll has the first bearing surface; the wear-resistant ring is in contact with the first bearing surface of the first wear-resistant plate;

and/or, the movable scroll comprises a second wear-resistant plate which is disposed at an end of the movable scroll adjacent to the fixed portion; an end of the second wear-resistant plate facing the fixed portion has the second bearing surface; and the wear-resistant ring is in contact with the second bearing surface of the second wear-resistant plate.

19. The scroll compressor according to claim 11, further comprising a housing and a driving assembly; the fixed portion and the driving assembly being at least partially installed in the housing; the driving assembly comprising a rotating shaft, a driving unit and a bearing; the rotating shaft being at least partly installed on the fixed portion through the bearing; one end of the rotating shaft being connected to the driving unit, and another end of the rotating shaft being eccentrically connected to the movable scroll; a first spiral wall on the movable scroll being in contact with a second spiral wall on the fixed scroll to form the compression chamber; the sealing assembly being resisted against the movable scroll and the fixed portion so as to seal the back pressure chamber between the movable scroll and the fixed portion.

20. The scroll compressor according to claim 19, wherein the fixed scroll comprises an end plate; an axial distance from the end plate adjacent to the movable scroll to the second bearing surface is $l_3$; an axial distance from a top end of the first spiral wall of the movable scroll to the second bearing surface is $l_4$, where $l_3-l_4=L_2$; an axial thickness of the wear-resistant ring is h, where $h>L_2$;

the fixed scroll is provided with a gas outlet port which communicates with a radially innermost compression chamber;

the pressure introduction hole comprises a gas inlet hole and a gas outlet hole; one end of the gas inlet hole is intermittently communicated with the gas outlet port, and another end of the gas inlet hole is communicated with the back pressure chamber; one end of the gas outlet hole is communicated with the compression chamber located radially outside a central compression chamber, and another end of the gas outlet hole is communicated with the back pressure chamber; and a shaft seal is disposed between the rotating shaft and the fixed portion.

* * * * *